US007670732B2

(12) United States Patent
Miura et al.

(10) Patent No.: US 7,670,732 B2
(45) Date of Patent: Mar. 2, 2010

(54) IMAGE FORMING METHOD, LIQUID DEVELOPING DEVICE, AND IMAGE FORMING APPARATUS

(75) Inventors: Satoru Miura, Matsumoto (JP); Hiroshi Kaiho, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 464 days.

(21) Appl. No.: 11/671,324

(22) Filed: Feb. 5, 2007

(65) Prior Publication Data

US 2007/0184371 A1 Aug. 9, 2007

(30) Foreign Application Priority Data

Feb. 7, 2006 (JP) ..... 2006-030099
Nov. 9, 2006 (JP) ..... 2006-304512

(51) Int. Cl.
*G03G 13/01* (2006.01)

(52) U.S. Cl. ..... 430/45.2; 430/115; 399/237

(58) Field of Classification Search ..... 430/45.2, 430/115; 399/237
See application file for complete search history.

(56) References Cited

U.S. PATENT DOCUMENTS 5,953,566 A * 9/1999 Fujiwara et al. ..... 399/223

FOREIGN PATENT DOCUMENTS

JP 2000-162829 6/2000

OTHER PUBLICATIONS

Machine translation of JP 2000-162829.*

* cited by examiner

*Primary Examiner*—Mark A Chapman
(74) *Attorney, Agent, or Firm*—Hogan & Hartson LLP

(57) ABSTRACT

An image forming method includes: by using a plurality of liquid developers having different colors, forming a plurality of single color images corresponding to the colors; transferring a non-fixed color image onto a recording medium; and fixing the non-fixed color image onto the recording medium. In the image forming method, each of the liquid developers includes an insulting liquid containing unsaturated fatty acid components and toner particles dispersed in the insulating liquid, and an oxidation polymerization accelerator that accelerates an oxidation polymerization reaction of the unsaturated fatty acid components during fixation is contained in the liquid developer forming the single color image that is positioned closest to the recording medium among the plurality of single color images forming the non-fixed color image.

11 Claims, 5 Drawing Sheets

IMAGE FORMING METHOD, LIQUID DEVELOPING DEVICE, AND IMAGE FORMING APPARATUS

BACKGROUND

1. Technical Field

The present invention relates to an image forming method, a liquid developing device, and an image forming apparatus.

2. Related Art

A method of using a liquid developer having toner particles dispersed in an insulating liquid to form an image on a recording medium has been proposed as an image forming method.

In the method using the liquid developer, the cohesion of toner particles is effectively prevented, as compared to a method of using dried toner, and thus it is possible to use minute toner particles and use a binding resin having a low softening point (low softening temperature). As a result, an image forming apparatus using the liquid developer can form a fine line image, a gray-scale image, and a color image with high reproducibility.

In general, a material having high chemical stability, such as petroleum hydrocarbon or silicon oil, is used as an insulating liquid used for the liquid developer.

However, the method using the liquid developer has a problem in that the insulating liquid adhered to the surfaces of toner particles during fixation sinks in the recording medium, which causes the strength of fixation to be lowered. The sinking of the insulating liquid makes it difficult to perform an additional writing on the recording medium with, for example, a ball-point pen.

In order to solve these problems, a technique for using naturally-derived oil and fat, such as vegetable oil, as an insulating liquid and using an oxidation polymerization reaction of the oil and fat for fixation is disclosed in JP-A-2000-162829.

However, in the technique disclosed in JP-A-2000-162829, an oxidation polymerization accelerator for accelerating an oxidation polymerization reaction, such as metal salt of fatty acid, is used to improve fixation characteristics. However, the oxidation polymerization accelerator deteriorates the color of a formed image and thus it is difficult to apply the oxidation polymerization accelerator to develop colors.

SUMMARY

An advantage of some aspects of the invention is that it provides an image forming method, a liquid developing device, and an image forming apparatus capable of being little influenced by environments and strongly fixing toner particles onto a recording medium while preventing a reduction in the quality of a formed image.

According to an aspect of the invention, an image forming method includes: using a plurality of liquid developers having different colors to form a plurality of single color images corresponding to the colors; transferring a non-fixed color image onto a recording medium; and fixing the non-fixed color image onto the recording medium. In the image forming method, each of the liquid developers includes an insulting liquid containing unsaturated fatty acid components and toner particles dispersed in the insulating liquid, and an oxidation polymerization accelerator that accelerates an oxidation polymerization reaction of the unsaturated fatty acid components during fixation is contained in the liquid developer forming the single color image that is positioned closest to the recording medium among the plurality of single color images forming the non-fixed color image.

In the image forming method according to the above-mentioned aspect, preferably, the oxidation polymerization accelerator is contained in only the liquid developer forming the single color image that is positioned closest to the recording medium among the plurality of single color images forming the non-fixed color image.

In the image forming method according to the above-mentioned aspect, preferably, a largest amount of oxidation polymerization accelerator is contained in the liquid developer forming the single color image that is positioned closest to the recording medium among the plurality of single color images forming the non-fixed color image.

In the image forming method according to the above-mentioned aspect, preferably, the oxidation polymerization accelerator content of the liquid developer forming the single color image that is positioned closest to the recording medium among the plurality of single color images forming the non-fixed color image is in a range of 0.01 to 2 parts by weight with respect to 100 parts by weight of insulating liquid.

In the image forming method according to the above-mentioned aspect, preferably, the liquid developer forming the single color image that is positioned closest to the recording medium among the plurality of single color images forming the non-fixed color image forms a single color image corresponding to black.

In the image forming method according to the above-mentioned aspect, preferably, the insulating liquid includes a glyceride of unsaturated fatty acid and fatty acid monoester.

In the image forming method according to the above-mentioned aspect, preferably, the oxidation polymerization accelerator is contained in the liquid developer in a capsulated state.

According to another aspect of the invention, a liquid developing device includes: a plurality of developing units that use a plurality of liquid developers having different colors to form a plurality of single color images corresponding to the colors; and a transfer unit that transfers the plurality of single color images corresponding to the colors onto a recording medium so as to be superimposed with each other, thereby forming a non-fixed color image on the recording medium. In the liquid developing device, each of the liquid developers includes an insulting liquid containing unsaturated fatty acid components and toner particles dispersed in the insulating liquid, and an oxidation polymerization accelerator that accelerates an oxidation polymerization reaction of the unsaturated fatty acid components during fixation is contained in the liquid developer forming the single color image that is positioned closest to the recording medium among the plurality of single color images forming the non-fixed color image.

In the liquid developing device according to the above-mentioned aspect, preferably, the transfer unit includes: an intermediate transfer unit onto which the plurality of single color images formed by the plurality of developing units are sequentially transferred and which forms an intermediate transfer image by superimposing the plurality of single color images transferred; and a secondary transfer unit that transfers the intermediate transfer image onto the recording medium. Preferably, one of the plurality of developing units that finally transfers the single color image onto the intermediate transfer unit contains the liquid developer including the oxidation polymerization accelerator.

In the liquid developing device according to the above-mentioned aspect, preferably, the transfer unit sequentially transfers the plurality of single color images formed by the plurality of developing units onto the recording medium when the recording medium is transported and forms the non-fixed color image obtained by superimposing the plurality of transferred single color images on the recording medium.

In the liquid developing device according to the above-mentioned aspect, preferably, the transfer unit includes: an intermediate transfer unit onto which the plurality of single color images formed by the plurality of developing units are sequentially transferred so as to be superimposed with each other and which forms an intermediate transfer image by superimposing the plurality of single color images transferred; a secondary transfer unit onto which the intermediate transfer image is transferred and which transports the intermediate transfer image transferred; and a tertiary transfer unit which transfers the intermediate transfer image onto the recording medium to form the non-fixed color image onto the recording medium.

In the liquid developing device according to the above-mentioned aspect, preferably, the developing unit includes a liquid developer reservoir that contains the liquid developer, and a reducing member that is formed of zeorite, which is a main component, and reduces the oxidized unsaturated fatty acid components is provided in the liquid developer reservoir that contains the liquid developer forming the single color image that is positioned closest to the recording medium among the plurality of single color images forming the non-fixed color image.

According to still another aspect of the invention, an image forming apparatus includes: a liquid developing device that includes a plurality of developing units which use a plurality of liquid developers having different colors to form single color images corresponding to the colors and a transfer unit which transfers a non-fixed color image onto a recording medium; and a fixing device that fixes the non-fixed color image formed on the recording medium. In the image forming apparatus, each of the liquid developers includes an insulting liquid containing unsaturated fatty acid components and toner particles dispersed in the insulating liquid, and an oxidation polymerization accelerator that accelerates an oxidation polymerization reaction of the unsaturated fatty acid components during fixation is contained in the liquid developer forming the single color image that is positioned closest to the recording medium among the plurality of single color images forming the non-fixed color image.

According to the above-mentioned structure, it is possible to provide an image forming method, a liquid developing device, and an image forming apparatus capable of being little influenced by environments and strongly fixing toner particles onto a recording medium while preventing a reduction in the quality of a formed image.

BRIEF DESCRIPTION OF THE DRAWINGS

The invention will be described with reference to the accompanying drawings, wherein like numbers refer like elements.

DESCRIPTION OF EXEMPLARY EMBODIMENTS

Figure 1:
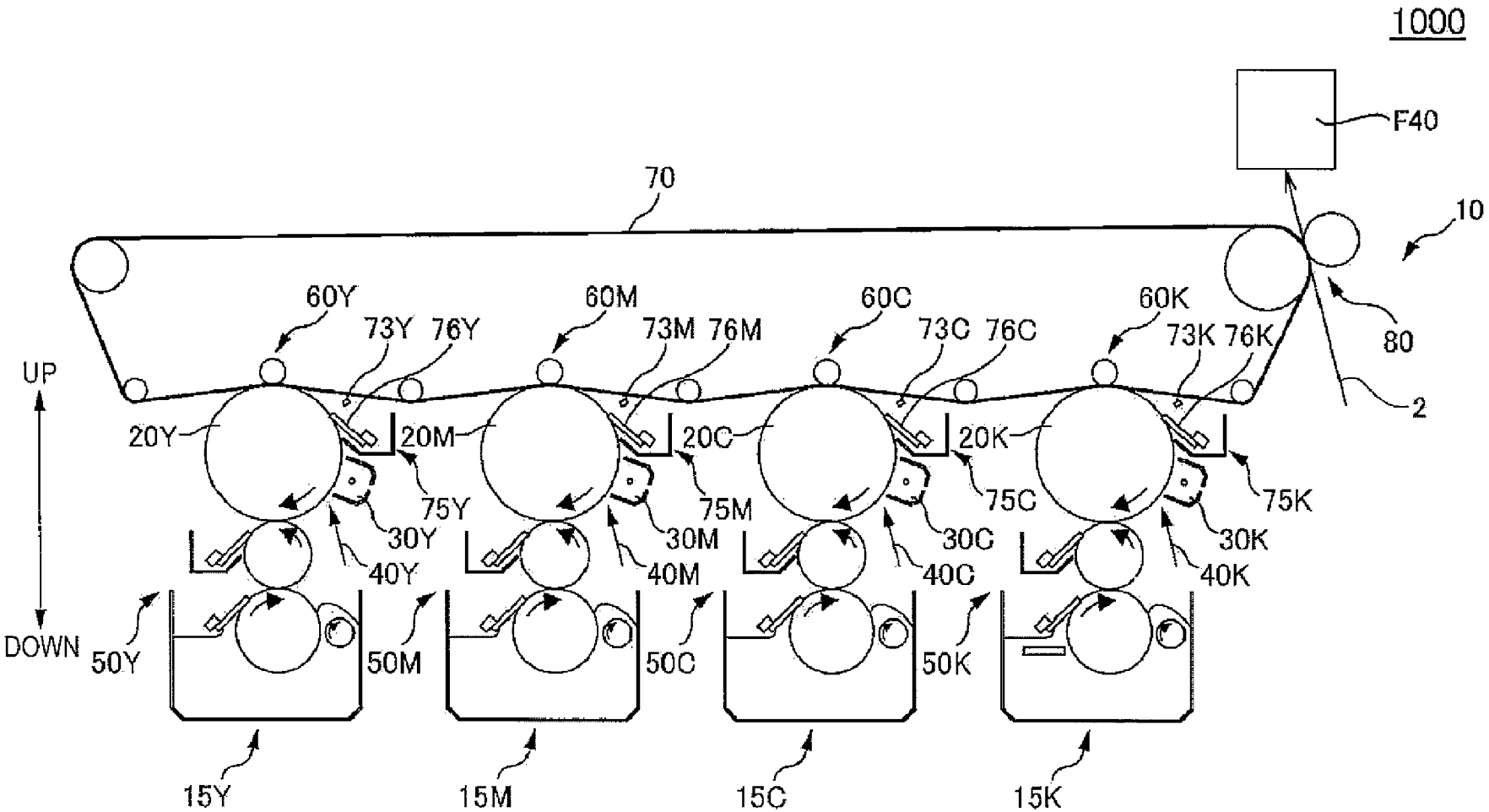
FIG. 1 is a diagram illustrating an example of an image forming apparatus according to an embodiment of the invention.

Hereinafter, exemplary embodiments of an image forming method, a liquid developing device, and an image forming apparatus according to embodiments of the invention will be described below.

First Embodiment of Image Forming Method

First, a first embodiment of an image forming method according to the invention will be described.

The image forming method according to this embodiment includes a developing process of using a plurality of liquid developer having different colors to form a plurality of single color images corresponding to the colors, and a transfer process of transferring the plurality of single color images corresponding to the colors onto a recording medium such that the plurality of single color images are superimposed on the recording medium to form a non-fixed color image, and a fixing process of fixing the non-fixed color image on the recording medium.

Further, in the image forming method of this embodiment, a liquid developer is composed of an insulating liquid containing unsaturated fatty acid components and toner particles dispersed in the insulating liquid.

Liquid Developer

First, the liquid developer used in the image forming method (a liquid developing device and an image forming apparatus) of the embodiment of the invention will be described in detail.

1. Insulating Liquid

First, the insulating liquid will be described.

The insulating liquid constituting the liquid developer used in the image forming method (liquid developing device, image forming apparatus) of the embodiment of the invention includes unsaturated fatty acid components having unsaturated bonds.

These unsaturated fatty acid components are substances which are harmless to environment. Thus, it is possible to reduce the leakage of the insulating liquid to the portions outside the liquid developing device, and the loading of the insulating liquid to environment due to the disposal of a liquid developer to be used. As a result, it is possible to provide an image forming method which is also harmless to environment.

Further, the unsaturated fatty acid components are components to be oxidation-polymerized by heating, etc. upon fixation. Specifically, the unsaturated fatty acid components are components to improve the fixability of the toner particles by being cured themselves by oxidation polymerization. In particular, an oxidation polymerization accelerator can be used to accelerate the oxidation polymerization reaction, and thus to strongly fix the toner particles in a short time. In addition, by curing the unsaturated fatty acid components, the additional writing of the aqueous ballpoint pen to the fixed toner image can be ensured.

Since the unsaturated fatty acid components have a high affinity for the toner particles (resin materials constituting the toner particles), as in the invention, by using the unsaturated fatty acid components for the insulating liquid, the dispersibility of the toner particles can be improved. As a result, upon storage or preservation, etc., the toner particles can be effectively prevented from settling or aggregation.

Examples of the unsaturated fatty acids constituting the unsaturated fatty acid components include monounsaturated fatty acids such as oleic acid, palmitoleic acid and ricinoleic acid, polyunsaturated fatty acids such as linoleic acid, α-linolenic acid, γ-linolenic acid, arachidonic acid, docosahexaenoic acid (DHA) and eicosapentaenoic acid (EPA), and the like. These unsaturated fatty acids can be used singly or in combination of two or more thereof.

Among them, the polyunsaturated fatty acid components are preferably used, and further among the polyunsaturated fatty acid components, those having the conjugated unsaturated bonds (conjugated unsaturated fatty acid components) are preferably used. By this, the oxidation polymerization reaction can be more effectively performed.

Any conjugated unsaturated fatty acid component having a conjugated unsaturated bond can be used, and examples thereof include synthetic ones, or extracted ones from vegetable oils, or ones by conjugation of the unsaturated fatty acid components.

The above-described unsaturated fatty acid components can be obtained effectively from naturally derived oils such as vegetable oils, for example, dehydrated castor oil, tung oil, safflower oil, linseed oil, sunflower oil, corn oil, cotton seed oil, soy oil, sesame oil, corn oil, hemp seed oil, evening primrose oil, Black Currant oil, borage oil, sardine oil, mackerel oil, and herring oil, and various animal-derived oils.

Among them, the dehydrated castor oil is preferably used since it is rich in conjugated linoleic acid components (conjugated unsaturated fatty acid components), and more effectively performs an oxidation polymerization reaction. As a result, it is possible to more strongly fix a toner image.

In the insulating liquid, the content of the unsaturated fatty acid components based on the total fatty acid components is not particularly limited, but it is preferably 10 mol % or more, more preferably 20 mol % or more, and even more preferably 20 to 90 mol %. By this, upon fixation, the oxidation polymerization reaction can be more effectively performed.

Further, the unsaturated fatty acid components may be in any form in the insulating liquid. For example, in the insulating liquid, the unsaturated fatty acid components may exist as an unsaturated fatty acid (or a co-unsaturated fatty acid salt), or may be bound to other components to form a compound. Examples of such the compound include an ester of an unsaturated fatty acid component and an alcohol component (polyhydric alcohol component), and an amide of an unsaturated fatty acid component and an amine component (polyhydric amine component). Among these, preferred is ester, and more preferred is an ester of glycerin and an unsaturated fatty acid component (which may be referred to as 'an unsaturated fatty acid glycerides', hereinafter). In the insulating liquid, by forming such the ester, preservability and long-term stability of the liquid developer become excellent, as well as the fixing characteristics on the toner particles in the recording medium can be more excellent.

Further, the insulating liquid may contain, for example, the saturated fatty acid components as described below, in addition to the above-described components.

The saturated fatty acid components are components which function to maintain high stability of the liquid developer. Accordingly, if the insulating liquid contains the saturated fatty acid component, the chemical change of the liquid developer can be effectively prevented. As a result, the obtained liquid developer can have improved preservability, and long-term stability.

Further, the saturated fatty acid components function to maintain high electric insulation property and viscosity. Thus, if the insulating liquid contains the saturated fatty acid component, the liquid developer can maintain higher electric resistance. Appropriate viscosity makes the transportation characteristics of the liquid developer better.

Examples of the saturated fatty acid constituting the saturated fatty acid components include butyric acid (C4), caproic acid (C6), caprylic acid (CB), capric acid (C10), lauric acid (C12), myristic acid (C14), palmitic acid (C16), stearic acid (C18), arachidonic acid (C20); behenic acid (C22), and lignoceric acid (C24). These unsaturated fatty acids can be used singly or in combination of two or more thereof. Among the saturated fatty acids, those having 6 to 22 carbon atoms are preferable, those having 3 to 20 carbon atoms are more preferable, and those having 10 to 18 carbon atoms are even more preferable. By incorporation of the saturated fatty acid components composed of these saturated fatty acids, the above-described effects can be further remarkable.

For example, the saturated fatty acid components can be effectively derived from naturally occurring fatty oil, including vegetable fatty oil such as palm oil (particularly, palm kernel oil), coconuts oil, and coconut oil, and various animal fatty oil (e.g., butter).

If the insulating liquid contains the saturated fatty acid component, the content of the saturated fatty acid components based on the total fatty acid components in the insulating liquid is not particularly limited, but it is preferably 0.5 to 40 mol %, and more preferably 1 to 30 mol %. By using these contents, the insulating liquid can maintain high electric insulation property, and effectively progress the oxidation polymerization reaction upon fixing.

As such, if the insulating liquid includes the unsaturated fatty acid components and the saturated fatty acid components, the unsaturated fatty acid components and the saturated fatty acid components in the insulating liquid may exist in any form. For example, the unsaturated fatty acid components and the saturated fatty acid components in the insulating liquid may each independently exist as an unsaturated fatty acid (or an unsaturated fatty acid salt), or as a saturated fatty acid (or a saturated fatty acid salt), or alternatively they may be bound to other components to form a compound. Examples of such the compound include an ester of the unsaturated fatty acid component, the saturated fatty acid component, and an alcohol component (polyhydric alcohol component), and an amide of the unsaturated fatty acid component, the saturated fatty acid component, and an amine component (polyhydric amine component). Among these, preferred is the ester, and more preferred are the ester of glycerin, the unsaturated fatty acid component, and the saturated fatty acid component (which may be referred to as 'glycerides').

Further, the insulating liquid may contain, for example, fatty acid monoesters as described below, in addition to the above-described components.

The fatty acid monoester is an ester of fatty acid and a monohydric alcohol.

Since the fatty acid monoester has a low molecular weight and low viscosity, it penetrates into the resin particles (toner particles) during the fixing process to exhibit a plasticizing effect. By this plasticizing effect, in the case of using paper as a recording medium, for example, the toner particles are likely to get into the gaps between the paper fibers to improve the fixed strength of the toner particles, and thus fixing can be performed at a low temperature. By penetration of the toner particles into the gaps between the fibers of the recording medium, the obtained image becomes flat without any convexoconcave. As a result, the image is excellent in gloss.

Further, by the plasticizing effect, the toner particles corresponding to each color can be mixed with each other upon fixing, thereby preferably forming an image having a desired color tone.

In particular, if a polyester resin is used as the resin material constituting the toner particles, the above-described plasticizing effect is remarkably exhibited, thereby improving the fixing strength of the toner particles, as well as forming a color image having a highly excellent color tone.

In addition, since the fatty acid monoester is a component which easily penetrates into the recording medium, the fatty acid monoester attached around the surface of the toner particles, when the toner particles and the recording medium are brought into contact upon fixing, rapidly penetrates into the recording medium. With the penetration of the fatty acid monoester, a portion of the thermally decomposed toner particles (resin materials constituting the toner particles) is penetrated into the recording medium, which gives rise to an anchor effect, thereby obtaining an improved fixing strength. Further, with the penetration of the fatty acid monoester, a portion of the unsaturated fatty acid glyceride present around the surface of the toner particles is also penetrated, which makes the toner particles fixed more strongly by oxidation polymerization.

Moreover, this fatty acid monoester is a component which is harmless to environment. Thus, it is possible to reduce the leakage of the insulating liquid to the portions outside the image forming apparatus, and the loading of the insulating liquid to environment due to the disposal of a liquid developer to be used. As a result, there can be provided an image forming apparatus which is also harmless to environment.

The content of the fatty acid monoester in the insulating liquid is preferably 5 to 55 wt %, more preferably 10 to 50 wt %, and even more preferably 20 to 50 wt %. If the content of the fatty acid monoester is within the above range, the penetration of the insulating liquid into the recording medium can be improved, and the plasticizing effect can also be sufficiently exhibited. As a result, the toner particles can be fixed more strongly, as well as an image having a particularly excellent color tone can be formed.

Examples of the fatty acid monoester which can be used as a liquid developer of the embodiment of the invention include, but not limited thereto, alkyl (methyl, ethyl, propyl, butyl, etc.) monoesters of unsaturated fatty acid such as oleic acid, palmitoleic acid, linoleic acid, α-linolenic acid, γ-linolenic acid, arachidonic acid, docosahexaenoic acid (DHA) and eicosapentaenoic acid (EPA), and alkyl (methyl, ethyl, propyl, butyl, etc.) monoesters of saturated fatty acid such as butyric acid, caproic acid, caprylic acid, capric acid, lauric acid, myristic acid, palmitic acid, stearic acid, arachidonic acid, behenic acid and lignoceric acid. These can be used singly or in combination of two or more thereof.

It is preferable to use an unsaturated fatty acid monoester having the above-described unsaturated fatty acid component as the fatty acid monoester. The unsaturated fatty acid component is a component which is contributable to improvement on the fixability of the toner particles on the recording medium. To be more specific, the unsaturated fatty acid monoester is cured itself by oxidation polymerization upon fixing to improve particularly the fixing strength of the toner particles on the recording medium. In this way, in addition to the unsaturated fatty acid glycerides, the unsaturated fatty acid monoester can also contribute to oxidation polymerization, so that the anchor effect can be effectively exhibited, which makes it possible to obtain particularly excellent fixing strength.

The content of the unsaturated fatty acid component based on the total fatty acid component in the fatty acid monoester is preferably 50 mol % or more, and more preferably 60 mol % or more. By this, the above-described effect is assured, and particularly strong fixing strength can be obtained.

Further, the fatty acid component of the fatty acid monoester is preferably composed mainly of the unsaturated fatty acids, but it may be partly composed of the saturated fatty acids. In this way, the insulating liquid can have improved preservability and long-term stability.

The fatty acid monoester is an ester of fatty acid and a monohydric alcohol. The alcohol is preferably an alkyl alcohol having 1 to 4 carbon atoms. In this way, the liquid developer can have excellent chemical stability, and the liquid developer has improved preservability and long-term stability. Further, by using preferable viscosity of the insulating liquid, the liquid developer can be preferably penetrated into the recording medium. Examples of the alcohol include methanol, ethanol, propanol, butanol and isobutanol.

Further, the fatty acid monoester constituting the insulating liquid is preferably a product obtained by esterification of a fatty acid glyceride and a monohydric alcohol having 1 to 4 carbon atoms. By this, the affinity of the fatty acid monoester for the fatty acid glyceride is further improved, which allows the viscosity of the insulating liquid to be preferable, thereby obtaining more excellent penetration of the liquid developer to the recording medium. By this, the fixing strength of the toner particles on the recording medium becomes excellent, and the toner particles can be used for the liquid developer employed in rapid image forming.

If the insulating liquid is composed of the unsaturated fatty acid glycerides and the fatty acid monoester as described above, it is preferable that the condition of $0.1 \leqq A/B \leqq 9$, preferably $0.4 \leqq A/B \leqq 9$, and more preferably $0.6 \leqq A/B \leqq 9$ is satisfied when the content of the unsaturated fatty acid glycerides in the insulating liquid is to be A [wt %], and the content of the fatty acid monoester is to be B [wt %]. By satisfying these conditions, the insulating liquid can have a preferable viscosity, and the penetration of the insulating liquid to the recording medium can be improved. As a result, the anchor effect by curing the unsaturated fatty acid component as described above is exhibited, and the fixing strength of the toner particles on the recording medium can be excellent. In addition, a more remarkable plasticizing effect can be obtained, and the gloss of the formed image can be excellent.

Further, if the insulating liquid is composed of the unsaturated fatty acid glyceride and the fatty acid monoester as described above, the content of the unsaturated fatty acid glycerides in the insulating liquid is specifically preferably 20 to 90 wt %, and more preferably, 40 to 90 wt %.

If the insulating liquid is composed of the unsaturated fatty acid glyceride and the fatty acid monoester as described above, the content of the fatty acid monoester in the insulating liquid is specifically preferably 10 to 80 wt %, and preferably 10 to 60 wt %.

The liquid developer (insulating liquid) may contain an antioxidant to prevent the oxidation of the insulating liquid. By this, the unsaturated fatty acid component can be prevented from oxidation unwillingly.

Examples of such an antioxidant include vitamin E such as tocopherol, d-tocopherol, dl-α-tocopherol, acetic acid-α-tocopherol, acetic acid dl-α-tocopherol, tocopherol acetate, and α-tocopherol, a vitamin C such as dibutyl hydroxy toluene, butyl hydroxy anisole, ascorbic acid, ascorbic acid salts (ascorbate), and ascorbate stearic acid ester, green tea extract, green coffee bean extract, sesamol, sesaminol, and the like. These antioxidants may be used singly or in combination with two or more thereof.

Among these substances, when a vitamin E is used, it is possible to obtain the following effects. That is, a vitamin E is a substance which is harmless to environment, and its oxidative product produced by oxidation thereof gives only small affects on the liquid developer. Further, since a vitamin E is a substance having high dispersibility in a liquid containing the unsaturated fatty acid component (in particular, glycerides), it can be used as the antioxidant preferably. Furthermore, by using a vitamin E together with the glyceride, it is possible to further improve affinity of the toner particles with the insulating liquid, thereby enabling the storage stability of the liquid developer and the fixability of the toner particles on the recording medium to be improved further.

Further, among the substances mentioned above, when a vitamin C is used, it is possible to obtain the following effects. Namely, as is the same with the vitamin E described above, a vitamin C is a substance which is harmless to environment, and its oxidative product produced by oxidation thereof gives only small affects to the liquid developer. Further, since a vitamin C is a substance having a relatively low pyrolysis temperature, it can exhibit a function as the antioxidant sufficiently during the storage or preservation of the liquid developer (including idling of the image forming apparatus) while the function as the antioxidant is lowered during the fixing process so that the oxidation polymerization reaction of the insulating liquid is more reliably promoted.

It is preferred that the pyrolysis temperature of the antioxidant is lower than the fixing temperature during the fixing process. This makes it possible to prevent deterioration of the insulating liquid during the storage or preservation of the liquid developer more reliably. Further, the antioxidant contained in the insulating liquid adhering to the surfaces of the toner particles is pyrolyzed during the fixing process. Thus, it is possible to promote the curing (oxidation polymerization reaction) of the insulating liquid, and as a result, fixability of the toner particles on the recording medium can be sufficiently promoted.

The pyrolysis temperature of the antioxidant is preferably equal to or lower than 200° C., and more preferably equal to or lower than 180° C. This makes it possible for the antioxidant to exhibit its function sufficiently, while more effectively improving the fixing strength of the toner particles.

The electric resistance of the insulating liquid at room temperature (20° C.) described above is preferably equal to or higher than $1\times10^{9}$ Ωcm, more preferably equal to or higher than $1\times10^{11}$ Ωcm, and even more preferably equal to or higher than $1\times10^{13}$ Ωcm.

Further, the dielectric constant of the insulating liquid is preferably equal to or lower than 3.5.

2. Oxidation Polymerization Accelerator

In this embodiment, only the liquid developer (which may be simply referred to a first liquid developer, hereinafter) forming a monochrome image located in the nearest side to the recording medium among a plurality of the monochrome images composing the unfixed color image formed on the recording medium contains an oxidation polymerization accelerator (curing accelerator) which accelerates the oxidation polymerization reaction (curing reaction) of the unsaturated fatty acid component upon fixing.

However, in general, the oxidation polymerization accelerator itself has a color such as a brown color. Thus, usually, if it is used for the color development, there is a problem that the color developed by the oxidation polymerization accelerator may deteriorate the color of the obtained image.

Thus, in the present embodiment, since the monochrome image near the surface layer of the unfixed toner image transferred to the recording medium contains no oxidation polymerization accelerator, the effect of the color of the oxidation polymerization accelerator can be minimized. As a result, deterioration of the image quality of the obtained image can be avoided.

Since the unfixed toner image is transferred such that the layer (monochrome) image including the oxidation polymerization accelerator and the recording medium are brought into contact, the insulating liquid including the oxidation polymerization accelerator is permeated to the recording medium to solidify the unsaturated fatty acid component by fixing. Thus, with an anchor effect, the toner particles can be fixed strongly.

There is no specific limitation on the types of the oxidation polymerization accelerator as long as it does not substantially participate in the oxidation polymerization of the unsaturated fatty acid component during storage or preservation (including idling of the image forming apparatus), and accelerates the oxidation polymerization reaction (curing) of the unsaturated fatty acid component during the fixing process.

Further, as the oxidation polymerization accelerator, use may be made of, for example, a substance having a function to accelerate the oxidation polymerization reaction (curing reaction) of the insulating liquid under a heating condition and substantially having no function to accelerate the oxidation polymerization reaction (curing reaction) of the unsaturated fatty acid component at around room temperature, that is, a substance having a relatively high activation energy in the oxidation polymerization reaction (curing reaction) of the unsaturated fatty acid component, can be used.

Examples of such the oxidation polymerization accelerator include metal salts of a fatty acid.

Examples of such the metal salts of a fatty acid include metal salts of a resin acid (e.g., a cobalt salt, a manganese salt and a lead salt thereof), metal salts of a linolenic acid (e.g., a cobalt salt, a manganese salt, and a lead salt thereof), metal salts of an octylic acid (e.g., a cobalt salt, a manganese salt, a lead salt, a zinc salt, and a calcium salt thereof), metal salts of a naphthenic acid (e.g., a zinc salt, a calcium salt, and a cobalt salt thereof). These metal salts of a fatty acid may be used singly or in combination with two or more thereof.

The oxidation polymerization accelerator may be contained in the insulating liquid in the encapsulated form. By using such encapsulated oxidation polymerization accelerator, it is possible for the oxidation polymerization accelerator not to substantially participate in the oxidation polymerization of the unsaturated fatty acid component during idling of the image forming apparatus, and to accelerate the oxidation polymerization reaction (curing) of the unsaturated fatty acid component during the fixing process. That is, it is possible to prevent oxidation polymerization reaction from being caused during the storage or preservation of the liquid developer more reliably. Further, since the capsules of the oxidation polymerization accelerator are collapsed with a predetermined pressure applied at the fixing process, it is possible to progress the oxidation polymerization reaction of the insulating liquid reliably by contacting the oxidation polymerization accelerator with the insulating liquid. As such, the materials for the oxidation polymerization accelerator can be selected from a wide range of the materials. Specifically, a high reactivity oxidation polymerization accelerator (i.e., an oxidation polymerization accelerator contributable to the oxidation polymerization reaction of the insulating liquid at a relatively low temperature) can be preferably used. Thus, the fixing strength of the toner particles on the recording medium can be particularly excellent.

Furthermore, the encapsulation of the oxidation polymerization accelerator may be carried out by the following manners. Firstly, an oxidation polymerization accelerator is prepared, and then the oxidation polymerization accelerator is dissolved in a solvent.

Any solvent is available as long as an oxidation polymerization accelerator can be dissolved therein. Examples of such solvents include inorganic solvents such as carbon disulfide, and carbon tetrachloride, and organic solvents such as ketone-based solvents (e.g., methyl ethyl ketone (MEK), methyl isopropyl ketone (MIPK), and 2-heptanone), alcohol-based solvents (e.g., pentanol, n-hexanol, 1-octanol, and 2-octanol), ether-based solvents (e.g., diethyl ether, and anisole), aliphatic hydrocarbon-based solvents (e.g., hexane, pentane, heptane, cyclohexane, octane, and isoprene), aromatic hydrocarbon-based solvents (e.g., toluene, xylene, benzene, ethyl benzene, and naphthalene), aromatic heterocyclic compound-based solvents (e.g., furan, and thiophene), halide-based solvents (e.g., chloroform), ester-based solvents (e.g., ethyl acetate, isopropyl acetate, isobutyl acetate, and ethyl acrylate), nitrile-based solvents (e.g., acrylonitrile), and nitro-based solvents (e.g., nitromethane and nitroethane). These materials can be used singly or in combination of two or more thereof.

Then, porous body such as hydrophilic silica, hydrophilic alumina, and hydrophilic titanium oxide is added to the resulting solution, thereby allowing the solution to be adsorbed by the porous body. Then, the porous body adsorbing the solution, a polyether such as polyethylene glycol, and polypropylene glycol are mixed under heating.

The mixing weight ratio of the porous body and the polyether is preferably around 1:0.5 to 1:10, and more preferably around 1:1 to 1:5 in a weight ratio.

The temperature for mixing the porous body and the polyether is preferably 5 to 80° C., and more preferably 20 to 80° C.

Then, the obtained mixture is sufficiently dispersed in a petroleum-based hydrocarbon, and then cooled to adsorb the polyether on the surface of the porous body. By this, a polyether film is formed on the surface of the porous body.

Thereafter, the resultant was filtered to remove the petroleum-based hydrocarbon, thereby obtaining an encapsulated oxidation polymerization accelerator.

The content of the oxidation polymerization accelerator in the first liquid developer is preferably 0.01 to 2 parts by weight, more preferably 0.05 to 1 part by weight, and even more preferably 0.1 to 0.8 parts by weight, based on 100 parts by weight of the insulating liquid. In this way, while sufficiently preventing the oxidation polymerization reaction upon storage or preservation of the liquid developer, for example, it is ensured that the oxidation polymerization reaction of the unsaturated fatty acid component is performed upon fixing, and further deterioration of the image quality can be avoided by addition of the oxidation polymerization accelerator.

3. Toner Particles

Hereinafter, the toner particles will be described.

Materials Constituting Toner Particles

The toner particles (toner) in part contain a binding resin (resin material).

(1) Resin Material

The toner particles contained in a liquid developer are constituted from a material which contains a resin material as its main component.

In the invention, there is no specific limitation on the kinds of a resin (binder resin) to be used. Examples of such a resin (binder resins) include homopolymers or copolymers including styrene or styrene substitute, such as polystyrene, poly-α-methyl styrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate ester copolymer, styrene-methacrylate ester copolymers, styrene-acrylate ester-methacrylate ester copolymers, styrene-α-chloracrylic methyl copolymer, styrene-acrylonitrile-acrylate ester copolymers, and styrene-vinyl methyl ether copolymers; polyester resins, epoxy resins, polyurethane modified epoxy resins, silicone modified epoxy resin, vinyl chloride resins, rosin modified maleic acid resins, phenyl resins, polyethylene resins, polypropylene, ionomer resins, polyurethane resins, silicone resins, ketone resins, ethylene-ethylacrylate copolymers, xylene resins, polyvinyl butyral resins, terpene resins, phenolic resins, and aliphatic or alicyclic hydrocarbon resins. These binder resins can be used singly or in combination of two or more thereof. Among these, a polyester resin can be used for improving the dispersibility of the toner particles in the liquid developer since it is thought that the polyester resin has a high affinity for the vegetable oils.

The softening point of the resin (resin material) is not particularly limited to any specific value, but it is preferably in the range of 50 to 130° C., more preferably in the range of 50 to 120° C., and even more preferably in the range of 60 to 115° C. In this specification, the term 'softening point' means a temperature at which softening is begun under the conditions that a temperature raising speed is 5° C./mim and a diameter of a die hole is 1.0 mm in a high-floored flow tester (manufactured by Shimadzu Corporation).

(2) Coloring Agent

The toner may also contain a coloring agent. As the coloring agent, there can be used, for example, a pigment or a dye. Examples of such pigments and dyes include carbon black, spirit black, lamp black (C.I. No. 77266), magnetite, titanium black, chrome yellow, cadmium yellow, mineral fast yellow, navel yellow, Naphthol Yellow S, Hansa Yellow G, Permanent Yellow NCG, chrome yellow, benzidine yellow, quinoline yellow, tartrazine lake, chrome orange, molybdenum orange, Permanent Orange GTR, pyrazolone orange, Benzidine Orange G, cadmium red, Permanent Red 4R, Watchung Red calcium salt, eosin lake, Brilliant Carmine 3B, manganese purple, Fast Violet B, methyl violet lake, Prussian blue, cobalt blue, alkali blue lake, Victoria blue lake, fast sky blue, Indanthrene Blue BC, ultramarine blue, aniline blue, phthalocyanine blue, Calco Oil Blue, chrome green, chromium oxide, Pigment Green B, malachite green lake, phthalocyanine green, Final Yellow Green G, Rhodamine 6G, quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, Nigrosine dye (C.I. No. 50415B), metal complex dyes, silica, aluminum oxide, magnetite, maghemite, various ferrites, metal oxides such as cupric oxide, nickel oxide, zinc oxide, zirconium oxide, titanium oxide and magnesium oxide, and magnetic materials including magnetic metals such as Fe, Co and Ni. These may be used singly or in combination of two or more.

(3) Other Components

The toner may also contain additional components other than the above components. Examples of such other components include a wax, a charge control agent, a magnetic powder, and the like.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty acid ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Examples of the charge control agent include a metallic salt of benzoic acid, a metallic salt of salicylic acid, a metallic salt of alkylsalicylic acid, a metallic salt of catechol, a metallic salt of stearic acid, a metal-containing bisazo dye, a nigrosine dye, tetraphenyl borate derivatives, a quaternary ammonium salt, an alkylpyridinium salt, chlorinated polyester, nitrohumic acid, and the like.

Further, examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, the constituent material of the toner may further contain zinc oxide, cerium oxide, silica, titanium oxide, iron oxide, fatty acid, or fatty acid metal salt, or the like in addition to the components described above.

Formation of Toner Particles

Hereinafter, the average diameter of the toner particles formed of the above-mentioned material is preferably in the range of 0.1 to 5 μm, more preferably, 0.1 to 4 μm, and even more preferably, 0.5 to 3 μm. When the average diameter of the toner particles is in the above-mentioned range, it is possible to sufficiently increase the resolution of an image formed by the liquid developer (toner).

The average value of the circularity R (average circularity) of the toner particles forming the liquid developer, which is represented by Expression (1) given below, is preferably in the range of 0.94 to 0.99, more particularly, 0.96 to 0.99:

$$R=L0/L1 \quad (1)$$

(where L1 [μm] indicates the peripheral length of a projected image of a toner particle to be measured and L0 [μm] indicates the peripheral length of a true circle having an area equal to the area of the projected image of the toner particle to be measured).

When the average circularity of the toner particles is within the above-mentioned range, it is possible to include an appropriate amount of insulating liquid in a non-fixed toner image transferred onto a recording medium and improve the fixing strength of the toner particles.

The toner particle content of the liquid developer is preferably in the range of 10 to 60 wt %, more particularly, 10 to 30 wt %.

The above-mentioned liquid developer may be manufactured by any of the following methods: a method of adding an electrolyte to a dispersion liquid (emulsifier) having a dispersion medium and a toner material dispersed in the dispersion medium to obtain associated particles, disintegrating the associated particles to obtain toner particles, and dispersing the toner particles in an insulating liquid; a method of grinding a toner material by a grinding method to obtain toner particles and dispersing the toner particles in an insulating liquid; and a method of manufacturing a liquid developer using a dispersion liquid obtained by dispersing toner particles in a dispersion medium (for example, see JP-A-2006-178117).

The image forming method according to this embodiment forms an image using the above-mentioned liquid developer. The image forming method includes a process of using a plurality of liquid developers having different colors to form a plurality of single color images corresponding to the color (developing process), a process of transferring the plurality of single color images onto a recording medium to form a non-fixed color image on the recording medium (transferring process), and a process of fixing the non-fixed color image onto the recording medium (fixing process). In this way, it is possible to provide an image forming method capable of being little influenced by environments and strongly fixing toner particles onto a recording medium while preventing a reduction in the quality of a formed image.

First Embodiment of Image Forming Apparatus (Liquid Developing Device)

Next, a first embodiment of an image forming apparatus (a liquid developing device) will be described below.

The image forming apparatus and the liquid developing device according to this embodiment use an insulating liquid containing unsaturated fatty acid components and toner particles dispersed in the insulating liquid to form a color image on a recording medium.

Figure 2:
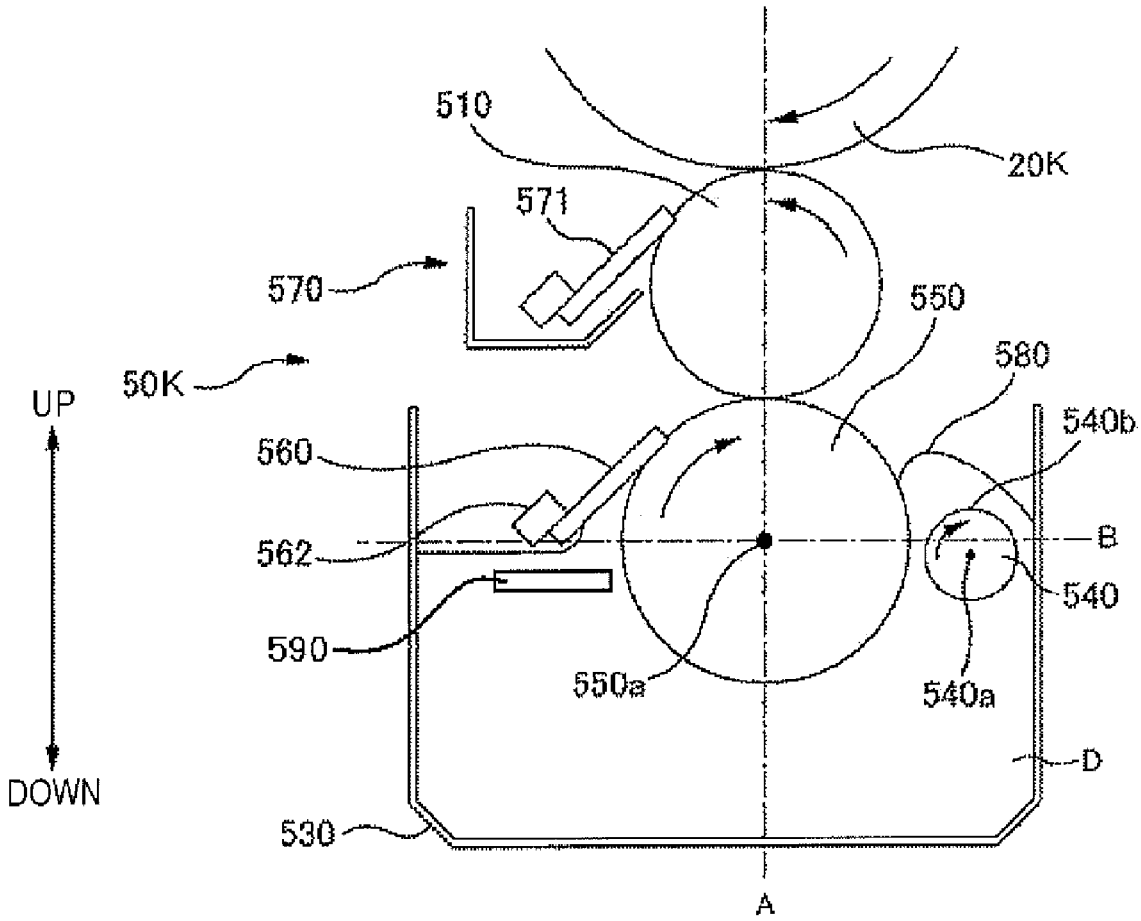
FIG. 2 is a diagram schematically illustrating an example of a developing unit provided in a liquid developing device according to the embodiment of the invention.
Figure 3:
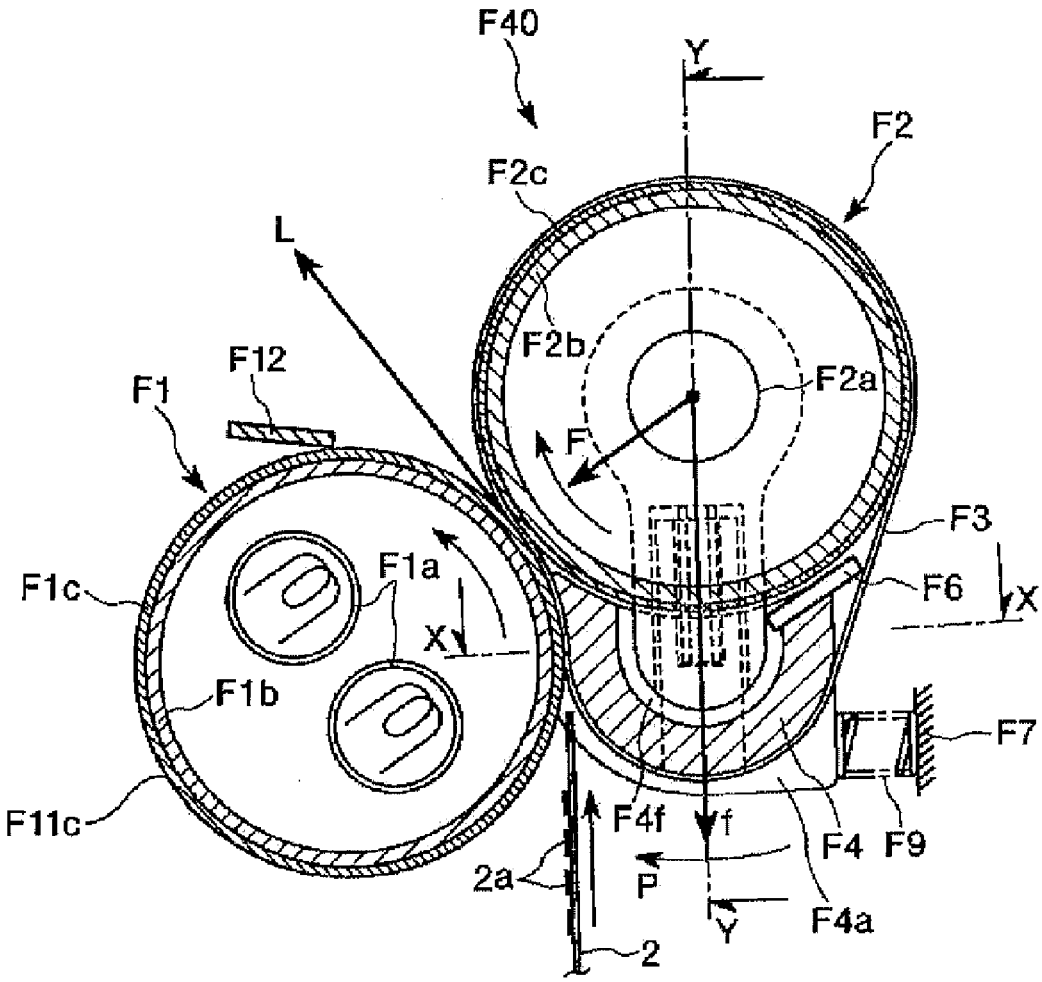
FIG. 3 is a cross-sectional view illustrating an example of a fixing device applied to the image forming apparatus according to the embodiment of the invention.

FIG. 1 is a diagram schematically illustrating the first embodiment of the image forming apparatus according to the invention. FIG. 2 is a diagram schematically illustrating an example of a developing unit provided in the liquid developing device according to this embodiment. FIG. 3 is a cross-sectional view illustrating an example of a fixing device used for the image forming apparatus according to this embodiment. In FIG. 1, an arrow indicates a vertical direction.

As shown in FIG. 1, an image forming apparatus 1000 includes a liquid developing device 10 and a fixing device F40.

Liquid Developing Device

First, the liquid developing device 10 will be described with reference to the accompanying drawings.

As shown in FIG. 1, the liquid developing device 10 includes four developing sections 15Y, 15M, 15C, and 15K, an intermediate transfer section 70, and a secondary transfer unit (second transfer section) 80

The four developing sections 15Y, 15M, 15C, and 15K use a yellow (Y) liquid developer, a magenta (M) liquid developer, a cyan (C) liquid developer, and a black (K) liquid developer to develop a latent image and form single color images corresponding to the colors, respectively.

The four developing sections 15Y, 15M, 15C, and 15K have the same structure, and thus the structure of the developing section 15K will be described as a representative example.

As shown in FIG. 1, the developing section 15K includes a photoconductor 20K, which is an example of an image carrier, a charging unit 30K, an exposure unit 40K, a developing unit 50K, a primary transfer unit 60K, a neutralizing unit 73K, and a photoconductor cleaning unit 75K. The charging unit 30K, the exposure unit 40K, the developing unit 50K, the primary transfer unit 60K, the neutralizing unit 73K, and the photoconductor cleaning unit 75K are arranged along the rotational direction of the photoconductor 20K.

The photoconductor 20K has a cylindrical base and a photosensitive layer formed on the circumferential surface thereof, and is rotatable on its central axis. In this embodiment, the photoconductor 20K rotates in a clockwise direction indicated by an arrow in FIG. 1.

The charging unit 30K charges the photoconductor 20K, and the exposure unit 40K radiates a laser beam to form a latent image on the charged photoconductor 20K. The exposure unit 40K includes, for example, a semiconductor laser, a polygon mirror, an F-θ lens, and radiates modulated laser beams onto the charged photoconductor 20K on the basis of an image signal input from a host computer (not shown), such as a personal computer or a word processor.

The developing unit 50K uses the black (K) liquid developer to develop the latent image formed on the photoconductor 20K. The developing unit 50K will be described in detail later.

The primary transfer unit 60K transfers a single color image formed on the photoconductor 20K onto the intermediate transfer section 70.

When the primary transfer units 60Y, 60M, 60C, and 60K sequentially transfer single color images corresponding to each color that are formed on the developing sections 15Y, 15M, 15C, and 15K, the single color images corresponding to each color are superimposed so that a full color developer image (intermediate transfer image) is formed on the intermediate transfer section 70, which will be described later).

The intermediate transfer section 70 is an endless belt wound around a plurality of support rollers, and is rotated while abutting on the photoconductors 20Y, 20M, 20C, and 20K.

The secondary transfer unit 80 secondarily transfers the intermediate transfer image formed on the intermediate transfer unit 70 onto a recording medium 2, such as a sheet, a film, or textile.

A non-fixed color image 2*a* transferred onto the recording medium 2 by the secondary transfer unit 80 is transmitted to the fixing device F40, which will be described later, to be fixed.

The neutralizing unit 73K neutralizes the remaining charge on the photoconductor 20K after the intermediate transfer image is transferred onto the intermediate transfer section 70 by the primary transfer unit 60K.

The photoconductor cleaning unit 75K has a rubber photoconductor cleaning blade 76K coming into contact with the surface of the photoconductor 20K, and scrapes away the liquid developer remaining on the photoconductor 20K to remove it by using the photoconductor cleaning blade 76K after the developer image is transferred onto the intermediate transfer section 70 by the primary transfer unit 60K.

The liquid developing device according to this embodiment is characterized in that a liquid developer including the above-mentioned oxidation polymerization accelerator is contained in a developing section that finally transfers a single color image onto the intermediate transfer section, among the plurality of developing sections. That is, the liquid developing device is characterized in that, among the plurality of developing sections, the developing section arranged in the last stage in the rotational direction of the intermediate transfer section contains the liquid developer including the oxidation polymerization accelerator. Specifically, the oxidation polymerization accelerator is included in a liquid developer (first liquid developer) forming a single color image located closest to the recording medium, among a plurality of single color images forming a non-fixed color image.

According to the above-mentioned structure, a layer including the oxidation polymerization accelerator is formed on a surface of the intermediate transfer section opposite to the surface having the intermediate transfer image formed thereon. When the intermediate transfer image is transferred onto a recording medium, the oxidation polymerization accelerator is not included in the vicinity of the surface of the non-fixed color image transferred onto the recording medium, which makes it possible to reduce the influence of the color of the oxidation polymerization accelerator on the quality of an image. As a result, it is possible to prevent a reduction in the display quality of a formed image.

In addition, the intermediate transfer image is transferred onto the recording medium such that the layer including the oxidation polymerization accelerator and the recording medium come into contact with each other. Therefore, the insulating liquid including the oxidation polymerization accelerator sinks into the recording medium and is then fixed thereto, which causes the unsaturated fatty acid components to be solidified. Therefore, an anchoring effect is exhibited, which makes it possible to strongly fix the toner particles.

In this embodiment, the developing section finally transferring a single color image onto the intermediate transfer section 70 is the black developing section 15K. That is, as described above, the oxidation polymerization accelerator is contained in the black liquid developer. This structure makes it possible to effectively reduce the influence of the color of the oxidation polymerization accelerator on the quality of a formed image. As a result, it is possible to reliably prevent a reduction in the quality of an image.

Next, the developing units 50Y, 50M, 50C, and 50K will be described in detail with reference to the accompanying drawings. The structure of the developing unit 50K will be described below as a representative example.

As shown in FIG. 2, the developing unit 50K includes a liquid developer reservoir 530, a liquid developer supply roller 550, a liquid pumping roller 540, a regulating blade 560, a developing roller 510, and a developing unit roller cleaning unit 570.

The liquid developer reservoir 530 contains a liquid developer D for developing the latent image formed on the photoconductor 20K.

As shown in FIGS. 1 and 2, the liquid developer reservoir 530 of the developing unit 50K is provided with a reducing member 590 for reducing oxidized unsaturated fatty acid components.

The reducing member 590 is arranged in the vicinity of the surface of the liquid developer D so as to come into contact with the liquid developer D in the liquid developer reservoir 530.

The unsaturated fatty acid components of the liquid developer D in the liquid developer reservoir 530 are oxidation polymerization components. Therefore, when the unsaturated fatty acid components are contained in the liquid developer reservoir 530 for a long time, the unsaturated fatty acid components may be oxidized with time. As a result, the performance of the unsaturated fatty acid components as an insulating liquid is deteriorated, which may cause a reduction in the quality of a formed image. In particular, this is more remarkable in a liquid developer containing the oxidation polymerization accelerator.

Therefore, the reducing member 590 for reducing the oxidized unsaturated fatty acid components is provided in the liquid developer reservoir 530, which makes it possible to prevent the performance of the insulating liquid from being deteriorated with time. As a result, it is possible to prevent a reduction in the quality of a formed image.

The reducing member 590 is mainly formed of zeolite.

The zeolite has a condensed aluminosilicate structure, and is crystal in which $SiO_4$ tetrahedrons or $AlO_4$ tetrahedrons obtained by substituting Al for Si are coupled in a three-dimensional mesh shape with oxygen atoms shared therebetween.

The zeolite has cation exchange capacity, which makes it possible to reduce the oxidized unsaturated fatty acid components.

The reducing member 590 is a porous member. The porous member can be obtained by baking zeolite powder.

When the reducing member 590 is formed of a porous member, the contact area of the reducing member 590 with the liquid developer D increases, which makes it possible to effectively reduce the unsaturated fatty acid components. In addition, it is possible to effectively prevent the unsaturated fatty acid components included in the liquid developer D from being oxidized by putting oxygen contained in the liquid developer D into minute holes.

The reducing member 590 has a porosity of about 50 to 80 vol %, preferably, about 70 to 80 vol %. In this way, it is possible to effectively reduce the unsaturated fatty acid components. In addition, it is possible to effectively put oxygen contained in the liquid developer D into minute holes.

The reducing member 590 is detachably provided, which makes it possible to replace the reducing member having low reduction ability or sorption capacity with a new one.

In the structure shown in FIG. 2, the reducing member 590 is provided in only the developing unit 50K (developing section 15K), but the invention is not limited thereto. For example, the reducing members 590 may be provided in the developing units 50Y, 50M, and 50C (developing sections 15Y, 15M, and 15C) in addition to the developing unit 50K. In this way, it is possible to prevent the unsaturated fatty acid components from being oxidized in developing units other than the developing unit finally transferring a single color image onto the intermediate transfer section 70, and thus to effectively prevent the quality of a formed image.

The liquid developer supply roller 550 supplies the liquid developer D to the developing roller 510.

The surface of the liquid developer supply roller 550 comes into pressure contact with an elastic member, which will be described later, of the developing roller 510 such that the liquid developer supply roller 550 appropriately transfers the liquid developer D onto the developing roller 510. The liquid developer supply roller 550 can rotate on its central axis 550*a*, and the central axis 550*a* is arranged below the axis of the rotation of the developing roller 510. The liquid developer supply roller 550 rotates in a direction (a clockwise direction in FIG. 2) opposite to the rotational direction (a counterclockwise direction in FIG. 2) of the developing roller 510.

The liquid developer supply roller 550 is immersed in the liquid developer D contained in the liquid developer reservoir 530 with a portion thereof exposed. Therefore, when the liquid developer supply roller 550 rotates in this state, the liquid developer supply roller 550 is immersed in the liquid developer D on the right side of a vertical surface A passing through the central axis of the liquid developer supply roller 550 in FIG. 2, and emerges from the liquid developer D on the left side of the vertical surface A in FIG. 2.

The liquid pumping roller 540 raises the level of an immersion-side surface 580 where the liquid developer supply roller 550 is immersed in the liquid developer D by rotation to be higher than a horizontal surface B passing through the central axis 550*a* of the liquid developer supply roller 550. The liquid pumping roller 540 is a roller made by SUS Corporation, and has a diameter of about 10 mm.

The liquid pumping roller 540 is provided on a side of the vertical surface A where the liquid developer supply roller 550 is immersed in the liquid developer D by rotation (that is, on the right side of the vertical surface A in FIG. 2) such that the central axis 540*a* of the liquid pumping roller 540 is aligned with the central axis 550*a* of the liquid developer supply roller 550. In addition, the central axis 540*a* of the liquid pumping roller 540 is disposed below the central axis 550*a* of the liquid developer supply roller 550 in the vertical direction, and an upper end 540*b* of the liquid pumping roller 540 is disposed above the central axis 550*a* of the liquid developer supply roller 550 in the vertical direction. The liquid pumping roller 540 is separated from the liquid developer supply roller 550 by a distance of about 2 mm.

The liquid pumping roller 540 can rotate on its central axis 540*a*, and also rotates in the same direction as the liquid developer supply roller 550 (in a clockwise direction in FIG. 2). The liquid pumping roller 540 rotates at the same linear speed as that of the liquid developer supply roller 550.

The rotation of the liquid pumping roller 540 having the above-mentioned structure causes the level of the immersion-side surface 580 to be higher than the horizontal surface B. For example, when the liquid pumping roller 540 rotates with the level of the immersion-side surface 580 being lower than the horizontal surface B, the liquid developer D around the liquid pumping roller 540 is circulated by the rotation of the liquid pumping roller 540, so that the level of the immersion-side surface 580 is higher than the horizontal surface B.

In addition to the above-mentioned function, the liquid pumping roller 540 has a function of moving the liquid developer D contained in the liquid developer reservoir 530 toward the liquid developer supply roller 550 to supply the liquid developer D to the liquid developer supply roller 550 and a function of stirring the liquid developer D in order to keep the liquid developer D in an appropriate state.

The regulating blade 560 comes into contact with the surface of the liquid developer supply roller 550 to regulate the amount of the liquid developer D on the liquid developer supply roller 550. That is, the regulating blade 560 scrapes away the remaining liquid developer on the liquid developer supply roller 550 and measures the amount of liquid developer D on the liquid developer supply roller 550 to be supplied to the developing roller 510. The regulating blade 560 is formed of a urethane rubber, which is an elastic material, and is supported by a regulating blade support member 562 formed of a metallic material, such as iron. The regulating blade 560 is provided on a side of the vertical surface A where the liquid developer supply roller 550 rotates to be emerged from the liquid developer D (that is, on the left side of the vertical surface A in FIG. 2). The regulating blade 560 has a hardness of about 62 in JIS-A scale. A portion of the regulating blade 560 coming into contact with the surface of the liquid developer supply roller 550 has a hardness of about 62, which is lower than the hardness (about 85) of a portion of the elastic layer of the developing roller 510, which will be described later, coming into pressure contact with the surface of the liquid developer supply roller 550.

The developing roller 510 transports the liquid developer D to a developing potion opposite to the photoconductor 20K in order to develop the latent image carried on the photoconductor 20K with the liquid developer D. The developing roller 510 includes a core formed of a metallic material, such iron, and a conductive elastic layer provided on an outer circumferential portion of the core, and has a diameter of about 20 mm. The elastic layer has a two-layer structure of an inner layer formed of a urethane rubber having a hardness of about 30 in JIS-A scale and a thickness of about 5 mm and an outer layer formed of a urethane rubber having a hardness of about 85 in JIS-A scale and a thickness of about 30 μm. The outer layer of the developing roller 510 serves as a pressure contact portion, and is elastically deformed to come into pressure contact with the liquid developer supply roller 550 and the photoconductor 20K.

The developing roller 510 can rotate on its central axis, and the central axis of the developing roller 510 is arranged below the central axis of the rotation of the photoconductor 20K. In addition, the developing roller 510 rotates in a direction (the counterclockwise direction in FIG. 2) opposite to the rotational direction (the clockwise direction in FIG. 2) of the photoconductor 20K. When the latent image formed on the photoconductor 20K is developed, an electric field is formed between the developing roller 510 and the photoconductor 20K.

The developing roller cleaning unit 570 includes a developing roller cleaning blade 571 that is formed of rubber and comes into contact with the surface of the developing roller 510, and scrapes away the liquid developer D remaining on the developing roller 510 by using the developing roller cleaning blade 571 after developing is performed at the developing position.

In the developing unit 50K having the above-mentioned structure, the liquid pumping roller 540 rotates on its central axis 540*a* to move the liquid developer D contained in the liquid developer reservoir 530 to the liquid developer supply roller 550, thereby supplying the liquid developer D to the liquid developer supply roller 550.

The rotation of the liquid developer supply roller 550 causes the liquid developer D to reach a contact position of the regulating blade 560. When the liquid developer D passes through the contact position, the surplus of the liquid developer D is removed by the regulating blade 560, so that the amount of the liquid developer D supplied to the developing roller 510 is measured.

The liquid developer D on the liquid developer supply roller 550 reaches a pressure contact position with the developing roller 51 by the rotation of the liquid developer supply roller 550. The liquid developer D reached at the pressure contact position is transferred from the liquid developer supply roller 550 to the developing roller 510 by pressure generated by the pressure contact between the liquid developer supply roller 550 and the developing roller 510, and a thin film of the liquid developer D is formed on the developing roller 510.

The thin film of the liquid developer D formed on the developing roller 510 reaches a developing position opposite to the photoconductor 20K (that is, a position where the developing roller 510 comes into pressure contact with the photoconductor 20K) by the rotation of the developing roller 510, and contributes to the development of the latent image formed on the photoconductor 20K at the developing position under a predetermined electric field. Then, the rotation of the developing roller 510 causes the liquid developer D on the developing roller 510 having passed through the developing position to reach a contact position of the developing roller cleaning blade 571. When passing through the contact position, the liquid developer D adhered to the surface of the developing roller 510 is scraped away by the developing roller cleaning blade 571, and the scraped liquid developer D is collected into a remaining liquid developer collecting portion provided in the developing roller cleaning unit 570.

The rotation of the liquid developer supply roller 550 starts while the liquid pumping roller 540 is being rotated. That is, the liquid developing device 10 rotates the liquid pumping roller 540 and then rotates the liquid developer supply roller 550

Fixing Device

The fixing device F40 fixes a color image 2*a* on the recording medium 2 having a non-fixed color image 2*a* formed thereon by the liquid developing device.

As shown in FIG. 3, the fixing device F40 includes a thermal fixing roller F1, a pressure roller F2, a heat-resistant belt F3, a belt tension member F4, a cleaning member F6, a frame F7, and a spring F9.

The thermal fixing roller (fixing roller) F1 includes a roller base F1*b* composed of a pipe, an elastic member F1*c* covering the periphery of the roller base F1*b*, and a pillar-shaped halogen lamp F1*a*, serving as a heating source, that is provided inside the roller base F1*b*, and can be rotated in a counterclockwise direction indicated by an arrow.

The elastic member F1*c* of the thermal fixing roller F1 has a release layer F11*c* on the surface thereof.

The release layer F11*c* prevents toner particles from being adhered to the surface of the thermal fixing roller F1 during fixation.

The release layer F11*c* is formed of, for example, fluorine-contained rubber, such as, polytetrafluoroetylene (PTFE), tetrafluoroethylene-perfluoroalkyl vinyl ether copolymer (PFA), or tetrafluoroethylene hexafluoropropylene copolymer (FEP), or silicon rubber.

Two pillar-shaped halogen lamps F1*a* forming a heating source are provided inside the thermal fixing roller F1, and heating elements of the pillar-shaped halogen lamps F1*a* are arranged at different positions. BY selectively turning on the halogen lamps F1*a*, it is possible to easily carry out temperature control under different conditions, such as a wide recording medium and a narrow recording medium, or in a fixing nip part at which the heat-resistant belt F3, which will be described later, is wound around the heat fixing roller F1 and a part at which the belt tension member F4, which will be described later, comes into sliding contact with the heat fixing roller F1.

The pressure roller F2 is arranged so as to face the thermal fixing roller F1, and applies pressure to the recording medium 2 having a non-fixed color image formed thereon through the heat-resistant belt F3, which will be described later.

The pressure roller F2 includes a roller base F2*b* composed of a pipe and an elastic member F2*c* covering the outer circumference of the roller base F2*b*, and can be rotated in a clockwise direction indicated by an arrow.

The elastic member F1*c* of the thermal fixing roller F1 and the elastic member F2*c* of the pressure roller F2 are elastically deformed substantially uniformly to form a so-called horizontal nip. Further, there is no difference between the circumferential velocity of the thermal fixing roller F1 and the transporting speed of the heat-resistant belt F3, which will be described later, or the recording medium 2, which makes it possible to stably fix an image.

The heat-resistant belt F3 is an endless belt that is wound around the outer circumferences of the pressure roller F2 and the belt tension member F4 so that it can be moved with being held between the thermal fixing roller F1 and the pressure roller F2 in a pressed state.

The heat-resistant belt F3 is composed of a seamless tube having a thickness of 0.03 mm or more, and the seamless tube has a two-layer structure of a front surface (which contacts the recording medium 2) formed of PFA and a rear surface (which contacts the pressure roller F2 and the belt tension member F4) formed of polyimide. However, the structure of the heat-resistant belt F3 is not limited to the above-mentioned structure, but it may be formed of other materials, such as a metal tube, such as a stainless tube or a nickel electrocasting tube, and a heat-resistant resin tube, such as a silicone tube.

The belt tension member F4 is disposed on the upstream side of the fixing nip portion between the thermal fixing roller F1 and the pressure roller F2 in the direction in which the recoding medium 2 is transported. Further, the belt tension member F4 is pivotally disposed about a rotation shaft F2*a* of the pressure roller F2 so as to be movable in the direction of an arrow P.

The belt tension member F4 is configured so that the heat-resistant belt F3 extends with tension in the tangential direction of the thermal fixing roller F1 in a state in which the recording medium 2 does not pass through the fixing nip portion. When the fixing pressure is high at an initial position where the recording medium 2 enters the fixing nip portion, the recording medium 2 cannot smoothly enter the fixing nip portion, which may cause fixation to be performed with the leading end of the recording medium 2 being folded. However, in this embodiment, the belt tension member F4 is provided so that the heat-resistant belt P3 extends with tension in the tangential direction of the thermal fixing roller F1 as described above, which makes it possible to form an introducing portion for smoothly introducing the recording medium 2 and thus to stably introduce the recording medium 2 into the fixing nip part.

The belt tension member F4 is a substantially semicircular belt sliding member that is fitted into the inner circumference of the heat-resistant belt F3 to apply tension f to the heat-resistant belt F3 in cooperation with the pressure roller F2 (the heat-resistant belt F3 slidably moves on the belt tension member F4). The belt tension member F4 is arranged at a position where a portion of the heat-resistant belt F3 is wound toward the thermal fixing roller F1 from a tangential line L of a pressure contact portion between the thermal fixing roller F1 and the pressure roller F2, thereby forming a nip. A protruding wall F4*a* protrudes from one end or both ends of the belt tension member F4 in the axial direction thereof. When the heat-resistant belt F3 approaches one end in the axial direction, the heat-resistant belt F3 comes into contact with the protruding wall F4*a*. Therefore, the protruding wall F4*a* restricts the approach of the heat resistant belt F3 to the one end. Further, a spring F9 is provided between the frame and an end portion of the protruding wall F4*a* which is opposite to the thermal fixing roller F1 so as to slightly press the protruding wall F4*a* of the belt tension member F4 against the thermal fixing roller F1. In this way, the belt tension member F4 comes into sliding contact with the thermal fixing roller F1.

A position where the belt tension member F4 is slightly pressed against the thermal fixing roller F1 is a nip initial position, and a position where the pressure roller F2 is pressed against the thermal fixing roller F1 is a nip end position.

In the fixing device F40, the recording medium 2 having the non-fixed color image 2*a* formed by the image forming device, which will be described later, is transported from the nip initial position to the fixing nip portion and passes between the heat-resistant belt F3 and the thermal fixing roller F1 to come out of the nip end position, so that the non-fixed color image 2*a* formed on the recording medium 2 is fixed. Then, the recording medium is discharged in the tangent direction L of a portion of the pressure roller F2 pressed against the thermal fixing roller F1.

The cleaning member F6 is arranged between the pressure roller F2 and the belt tension member F4.

The cleaning member F6 comes into sliding contact with the inner circumferential surface of the heat-resistant belt F3 to clean, for example, foreign matters or abrasion powder on the inner circumferential surface of the heat-resistant belt F3. The cleaning of foreign matters or abrasion powder from the heat-resistant belt F3 makes it possible to refresh the heat-resistant belt F3 and remove unstable factors of the friction coefficients. In addition, a concave portion F4*f* is provided in the belt tension member F4 to collect the foreign matters or abrasion powder removed from the heat-resistant belt F3.

The fixing device F40 includes a removing blade (removing unit) F12 for removing the insulating liquid adhered to (remaining on) the surface of the thermal fixing roller F1 after the color image 2*a* is fixed on the recording medium 2. The oxidation polymerization accelerator removing blade F12 can remove the insulating liquid and toner adhered to the thermal fixing roller F1 during fixation.

In order to wind the heat-resistant belt F3 around the pressure roller F2 and the belt tension member F4 to stably drive the pressure roller F2, it is preferable to set the friction coefficient between the pressure roller F2 and the heat-resistant belt F3 to be larger than the friction coefficient between the belt tension member F4 and the heat-resistant belt F3. However, the friction coefficient may become unstable due to the infiltration of foreign matters between the heat-resistant belt F3 and the pressure roller F2 or between the heat-resistant belt F3 and the belt tension member F4, or the abrasion of a contact portion between the heat-resistant belt F3 and the pressure roller F2 and between the heat-resistant belt F3 and the belt tension member F4.

The winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2. With this structure, the distance that the heat resistant belt F3 slides on the belt tension member F4 becomes short, so that unstable factors due to deterioration with time and disturbance can be avoided or reduced. As a result, it is possible to stably drive the heat resistant belt F3 with the pressure roller F2.

The fixing temperature when a non-fixed color image is fixed is preferably in the range of 80 to 200° C., more preferably, 80 to 180° C. When the fixing temperature is in the above range, an oxidation polymerization reaction of the unsaturated fatty acid components can be progressed effectively. As a result, it is possible to effectively improve the fixing strength of toner particles.

Second Embodiment of Image Forming Apparatus (Liquid Developing Device)

Next, a second embodiment of the image forming apparatus (liquid developing device) according to the embodiment of the invention will be described below. In the following description, only the components of the image forming apparatus (liquid developing device) according to the second embodiment different from those in the first embodiment will be described, and a description of the same components as those in the first embodiment will be omitted.

The image forming apparatus according to the second embodiment uses the liquid developer described in the first embodiment to form a color image on a recording medium according to the image forming method according to the first embodiment.

Figure 4:
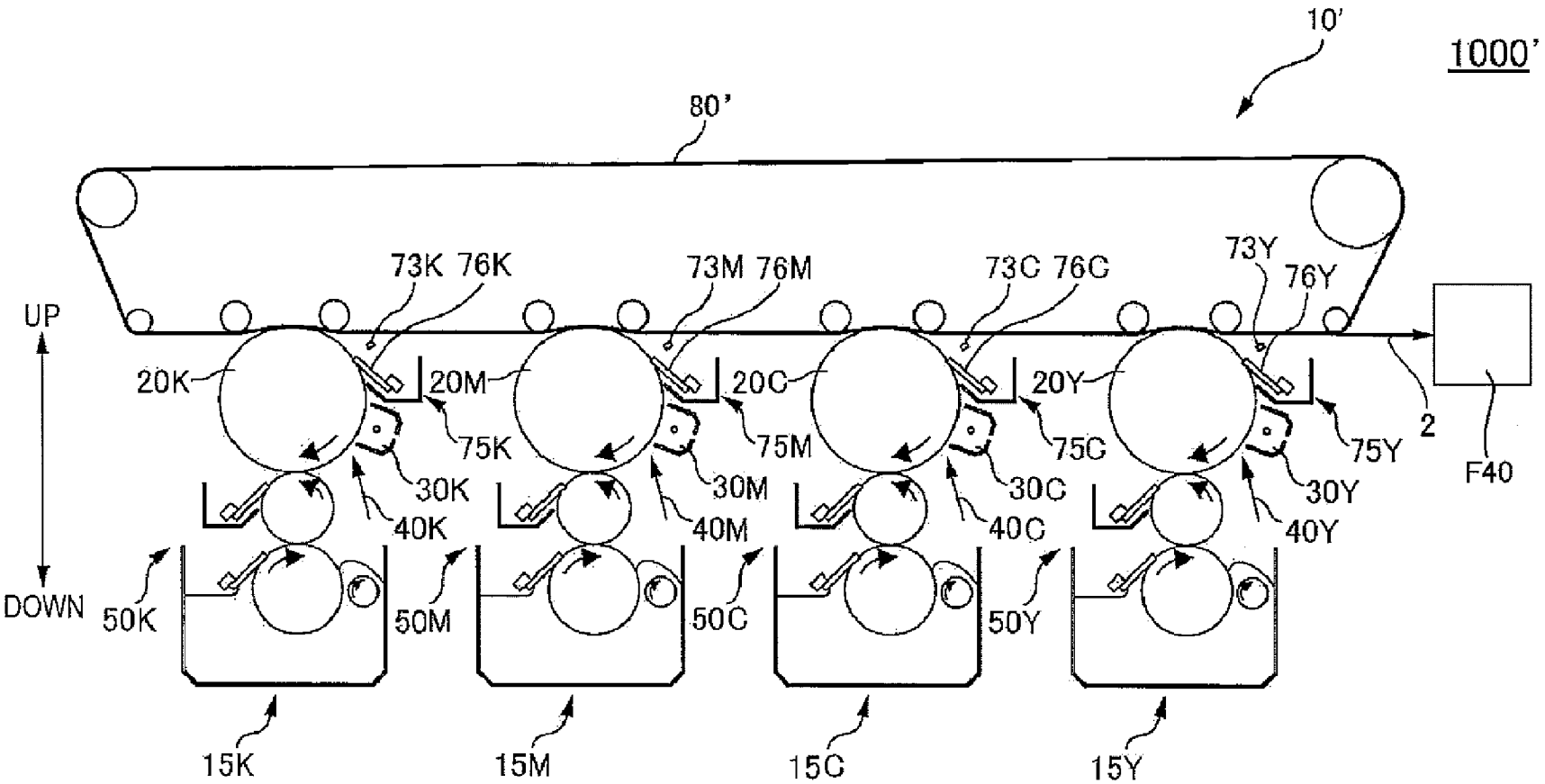
FIG. 4 is a diagram illustrating an image forming apparatus according to another embodiment of the invention.

FIG. 4 is a diagram schematically illustrating the second embodiment of the image forming apparatus according to the embodiment of the invention. In FIG. 4, an arrow indicates a vertical direction.

As shown in FIG. 4, an image forming apparatus 1000' includes a liquid developing device 10' and a fixing device F40.

Liquid Developing Device

First, the liquid developing device 10' will be described with reference to the accompanying drawings.

As shown in FIG. 4, the liquid developing device 10' includes four developing sections 15K, 15M, 15C, and 15Y and a transfer section (recording medium transporting belt) 80'.

Each of the developing sections 15K, 15M, 15C, and 15Y has the same structure as that in the first embodiment, and thus a description thereof will be omitted.

The transfer section (recording medium conveying belt) 80' is an endless belt wound around a plurality of support rollers and transports the recording medium 2.

The transfer section 801 is rotatably driven while coming into contact with the photoconductors 20K, 20M, 20C and 20Y.

The transfer section 80' is configured such that the transported recording medium 2 passes through a contact point between the transfer section 80' and each photoconductor.

Single color images formed by the developing sections are sequentially transferred onto the recording medium 2 when the recording medium passes through the contact potions with the photoconductors.

In the liquid developing device 10' according to this embodiment, the transfer section (conveyer belt) 801 sequentially transfers the single color images formed by the developing sections onto the recording medium 2 such that a plurality of singe color images are superimposed to form a non-fixed color image on the recording medium 2.

In this embodiment, as shown in FIG. 4, black, magenta, cyan, and yellow images are sequentially transferred onto the recording medium 2.

In this way, the non-fixed color image 2*a* formed on the recording medium 2 is fixed onto the recording medium 2 by the fixing device F40 described in the first embodiment.

In the liquid developing device 10' according to this embodiment, the oxidation polymerization accelerator is contained in only a developing section for transferring a single color image onto the recording medium 2 at the beginning, that is, a liquid developer contained in the developing section 15K.

That is, the oxidation polymerization accelerator is contained in only a liquid developer (first liquid developer) forming a single color image positioned closest to the recording medium, among a plurality of single color images forming the non-fixed color image.

In this structure, since the oxidation polymerization accelerator is not contained in the vicinity of the outer surface of the non-fixed color image 2*a* transferred onto the recording medium 2, it is possible to reduce the influence of the color of the oxidation polymerization accelerator on the quality of an image, and thus prevent a reduction in the quality of a formed image.

Since the non-fixed color image is transferred such that a layer including the oxidation polymerization accelerator (single color image) contacts the recording medium, an insulating liquid containing the oxidation polymerization accelerator sinks into the recording medium, and the unsaturated fatty acid components are hardened by fixation in this state, which causes an anchoring effect, making it possible to strongly fix toner particles.

In this embodiment, the developing section 15K corresponding to black transfers a single color image onto the recording medium 2 at the beginning. That is, the oxidation polymerization accelerator is contained in a liquid developer corresponding to black. This structure makes it possible to effectively reduce the influence of the color of the oxidation polymerization accelerator on the quality of an image and thus reliably prevent a reduction in the quality of a formed image.

Third Embodiment of Image Forming Apparatus (Liquid Developing Device)

Next, a third embodiment of the image forming apparatus (liquid developing device) according to the embodiment of the invention will be described below. In the following description, only the components of the image forming apparatus (liquid developing device) according to the third embodiment different from those in the first embodiment will be described, and a description of the same components as those in the first embodiment will be omitted.

The image forming apparatus (liquid developing device) according to the third embodiment uses the above-mentioned liquid developer to form a color image on a recording medium according to the image forming method according to the first embodiment.

Figure 5:
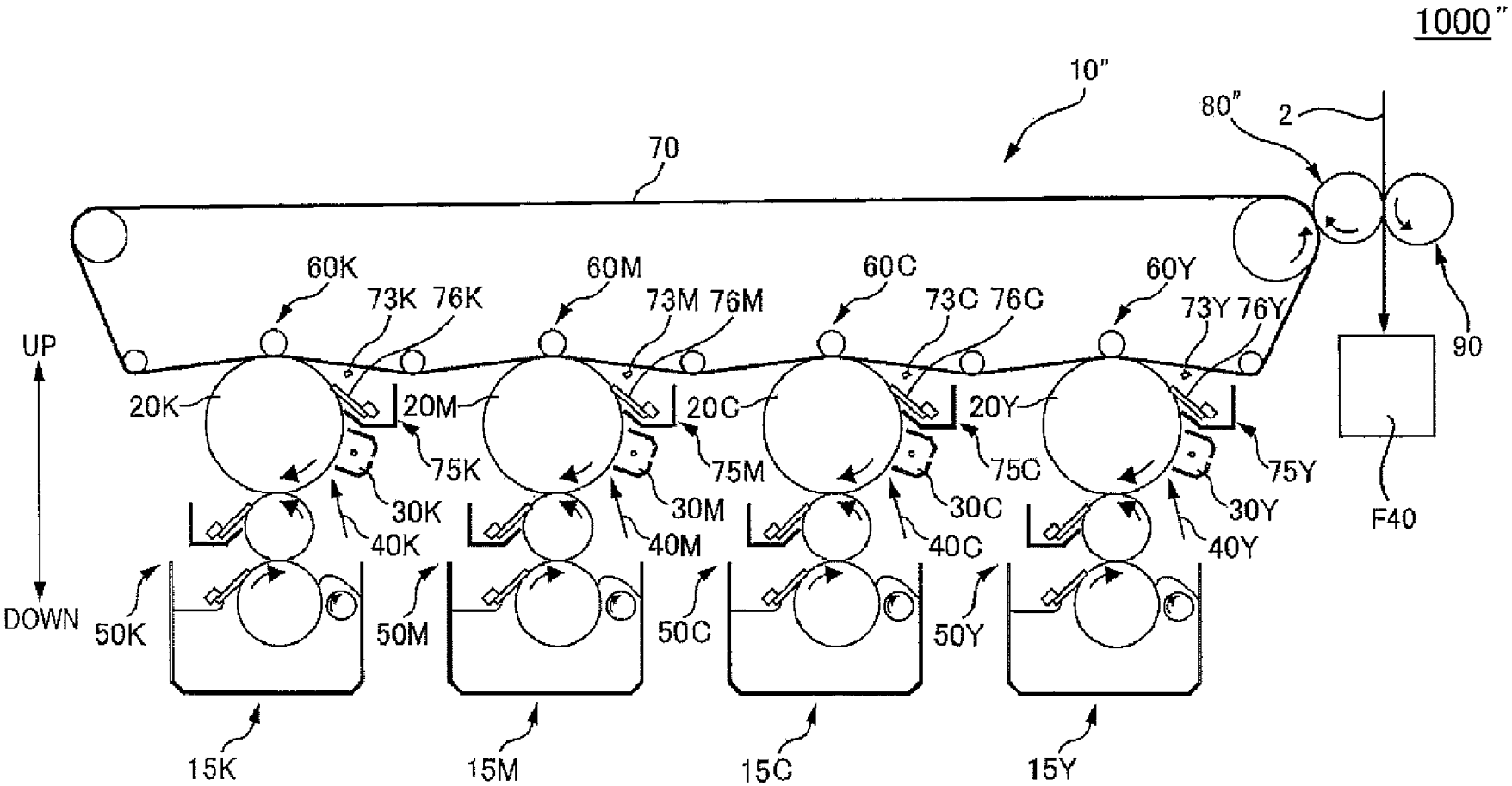
FIG. 5 is a diagram illustrating an image forming apparatus according to still another embodiment of the invention.

FIG. 5 is a diagram schematically illustrating the image forming apparatus according to the third embodiment of the invention.

As shown in FIG. 5, an image forming apparatus 1000' includes a liquid developing device 10" and a fixing device F40.

Liquid Developing Device

First, the liquid developing device 10" will be described with reference to the accompanying drawings.

As shown in FIG. 5, the liquid developing device 10" includes four developing sections 15K, 15M, 15C, and 15Y, an intermediate transfer section 70, a secondary transfer unit (secondary transfer section) 80", and a tertiary transfer unit (tertiary transfer section) 90.

Each of the developing sections 15K, 15M, 15C, and 15Y has the same structure as that in the first embodiment, and thus a description thereof will be omitted.

The intermediate transfer section 70 is an endless belt wounded around a plurality of support rollers, and rotates while coming into contact with photoconductors 20K, 20M, 20C, and 20Y.

Color images formed by the developing sections are sequentially transferred onto the intermediate transfer section 70, which will be described later, by primary transfer units 60K, 60M, 60C, and 60Y so as to be superimposed with each other, so that a full color image (intermediate transfer image) is formed.

The intermediate transfer image formed on the intermediate transfer section 70 is transferred onto the secondary transfer unit (secondary transfer section) 80", which will be described later.

The secondary transfer unit (secondary transfer section) 80" rotates in a direction opposite to the rotational direction of the intermediate transfer section 70 while coming into contact with the intermediate transfer section 70, and transfers the intermediate transfer image at a contact portion with the intermediate transfer section 70.

The secondary transfer unit 80" transports the intermediate transfer image and transfers the transported intermediate transfer image onto the tertiary transfer unit (tertiary transfer section) 90, which will be described later.

The tertiary transfer unit (tertiary transfer section) 90 transfers the intermediate transfer image transferred by the secondary transfer unit 80" onto the recording medium 2, such as a sheet, a film, or textile, to form a non-fixed color image 2*a* on the recording medium 2.

The non-fixed color image 2*a* transferred onto the recording medium 2 by the tertiary transfer unit 90 is transported to the fixing device F40, which will be described later, and is then fixed by the fixing device F40.

In the liquid developing device 10" according to this embodiment, the oxidation polymerization accelerator is contained in only a developing section for transferring a single color image onto the intermediate transfer section 70 at the beginning, that is, a liquid developer contained in the developing section 15K.

That is, the oxidation polymerization accelerator is contained in only a liquid developer (first liquid developer) forming a single color image positioned closest to the recording medium, among a plurality of single color images forming the non-fixed color image.

In this structure, since the oxidation polymerization accelerator is not contained in the vicinity of the outer surface of the non-fixed color image 2*a* transferred onto the recording medium 2, it is possible to reduce the influence of the color the oxidation polymerization accelerator on the quality of an image, and thus prevent a reduction in the quality of a formed image.

Since the non-fixed color image is transferred such that a layer including the oxidation polymerization accelerator (single color image) contacts the recording medium, an insulating liquid containing the oxidation polymerization accelerator sinks into the recording medium, and the unsaturated fatty acid components are hardened by fixation in this state, which causes an anchoring effect, making it possible to strongly fix toner particles.

Second Embodiment of Image Forming Method

Next, a second embodiment of the image forming method according to the embodiment of the invention will be described below. In the second embodiment of the image forming method, only the processes different from those in the first embodiment of the image forming method will be described, and a description of the same processes as those in the first embodiment will be omitted.

In this embodiment, the second embodiment of the image forming method is similar to the first embodiment of the image forming method except that a largest amount of oxidation polymerization accelerator is contained in a liquid developer (first liquid developer) forming a single color image that is positioned closest to a recording medium, among a plurality of single color images forming a non-fixed color image formed on the recording medium.

That is, this embodiment is characterized in that the oxidation polymerization accelerator content of the first liquid developer is larger than the oxidation polymerization accelerator content of a liquid developer other than the first liquid developer.

This structure makes it possible to prevent a reduction in the quality of a formed image and strongly fix toner particles to a recording medium. The reason is as follows.

That is, since the single color image in the vicinity of the outer surface of the non-fixed color image transferred onto the recording medium has a lower oxidation polymerization accelerator content than a single color image formed of the first liquid developer, it is possible to reduce the influence of the color of the oxidation polymerization accelerator on the quality of an image and thus prevent a reduction in the quality of a formed image.

Further, since the non-fixed toner image is transferred such that a layer containing a largest amount of oxidation polymerization accelerator (single color layer) contacts the recording medium, it is possible to strongly fix toner particles.

Similar to the first embodiment of the image forming method, the oxidation polymerization accelerator content of the first liquid developer is within a range of 0.01 to 2 parts by weight, preferably, 0.05 to 1 part by weight, more preferably, 0.1 to 0.8 part by weight with respect to 100 parts by weight of insulating liquid. In this way, it is possible to sufficiently prevent an oxidation polymerization reaction when the liquid developer is preserved and to reliably progress the oxidation polymerization reaction of the insulating liquid during fixation. In addition, it is effectively prevent a reduction in the quality of an image due to addition of the oxidation polymerization accelerator.

The oxidation polymerization accelerator content of a liquid developer other than the first liquid developer depends on a corresponding color. For example, when the first liquid developer corresponds to black, the oxidation polymerization accelerator content of a liquid developer corresponding to magenta is 1.5 parts by weight or less, preferably, 0.7 part by weight or less with respect to 100 parts by weight of insulating liquid. In this way, it is possible to sufficiently reduce the influence of the color of the oxidation polymerization accelerator on the quality of a formed image.

For example, when the first liquid developer corresponds to black, the oxidation polymerization accelerator content of a liquid developer corresponding to yellow is 0.15 part by weight or less, preferably, 0.05 part by weight or less with respect to 100 parts by weight of insulating liquid. In this way, it is possible to sufficiently reduce the influence of the color of the oxidation polymerization accelerator on the quality of a formed image.

When the first liquid developer corresponds to black, the oxidation polymerization accelerator content of a liquid developer corresponding to cyan is 0.6 part by weight or less, preferably, 0.4 part by weight or less with respect to 100 parts by weight of insulating liquid. In this way, it is possible to sufficiently reduce the influence of the color of the oxidation polymerization accelerator on the quality of a formed image.

Fourth Embodiment of Image Forming Apparatus (Liquid Developing Device)

Next, a fourth embodiment of the image forming apparatus (liquid developing device) according to the embodiment of the invention will be described below. In the following description, only the components of the image forming apparatus (liquid developing device) according to the fourth embodiment different from those in the first embodiment will be described, and a description of the same components as those in the first embodiment will be omitted.

The image forming apparatus (liquid developing device) according to the fourth embodiment uses the above-mentioned liquid developer to form a color image on a recording medium according to the image forming method according to the second embodiment.

As shown in FIG. 1, an image forming apparatus 1000 according to this embodiment includes a liquid developing device 10 and a fixing device F40, similar to the image forming apparatus according to the first embodiment.

The image forming apparatus 1000 (liquid developing device 10) according to the fourth embodiment is similar to the image forming apparatus according to the first embodiment (liquid developing device) except that a largest amount of oxidation polymerization accelerator is contained in a liquid developer contained in a developing section that finally transfers a single color image onto an intermediate transfer section 70, that is, a developing section 15K.

That is, a largest amount of oxidation polymerization accelerator is contained in a liquid developer (first liquid developer) forming a single color image that is positioned closest to a recording medium, among a plurality of single color images forming a non-fixed color image.

That is, this embodiment is characterized in that the oxidation polymerization accelerator content of the liquid developer contained in the developing section that finally transfers a single color image onto the intermediate transfer section 70 is larger than the oxidation polymerization accelerator content of a liquid developer contained in each of the other developing sections.

This structure causes the single color image in the vicinity of the outer surface of the non-fixed toner image transferred onto the recording medium to have a lower oxidation polymerization accelerator content than a single color image formed of the first liquid developer, which makes it possible to reduce the influence of the color of the oxidation polymerization accelerator on the quality of an image and thus prevent a reduction in the quality of a formed image.

Further, since the non-fixed toner image is transferred such that a layer containing a largest amount of oxidation polymerization accelerator (single color image) contacts the recording medium, it is possible to strongly fix toner particles.

The oxidation polymerization accelerator content is the same as that in the image forming method according to the second embodiment.

Fifth Embodiment of Image Forming Apparatus (Liquid Developing Device)

Next, a fifth embodiment of the image forming apparatus (liquid developing device) according to the embodiment of the invention will be described below In the following description, only the components of the image forming apparatus (liquid developing device) according to the fifth embodiment different from those in the second embodiment will be described, and a description of the same components as those in the second embodiment will be omitted.

The image forming apparatus (liquid developing device) according to the fifth embodiment uses the above-mentioned liquid developer to form a color image on a recording medium according to the image forming method according to the second embodiment.

As shown in FIG. 4, an image forming apparatus 1000' according to this embodiment includes a liquid developing device 10' and a fixing device F40, similar to the image forming apparatus according to the second embodiment.

The image forming apparatus 1000' (liquid developing device 10') according to the fifth embodiment is similar to the image forming apparatus (liquid developing device) according to the second embodiment except that a largest amount of oxidation polymerization accelerator is contained in a liquid developer contained in a developing section that transfers a single color image onto a recording medium 2 at the beginning, that is, a developing section 15K.

That is, a largest amount of oxidation polymerization accelerator is contained in a liquid developer (first liquid developer) forming a single color image that is positioned closest to a recording medium, among a plurality of single color images forming a non-fixed color image.

That is, this embodiment is characterized in that the oxidation polymerization accelerator content of the liquid developer contained in the developing section that transfers a single color image onto the recording medium 2 at the beginning is larger than the oxidation polymerization accelerator content of a liquid developer contained in each of the other developing sections.

This structure causes the single color image in the vicinity of the outer surface of the non-fixed toner image transferred onto the recording medium to have a lower oxidation polymerization accelerator content than a single color image formed of the first liquid developer, which makes it possible to reduce the influence of the color of the oxidation polymerization accelerator on the quality of an image and thus prevent a reduction in the quality of a formed image.

Further, since the non-fixed toner image is transferred such that a layer C single color image, containing a largest amount of oxidation polymerization accelerator contacts the recoding medium, it is possible to strongly fix toner particles.

The oxidation polymerization accelerator content is the same as that in the second embodiment of the image forming method.

Sixth Embodiment of Image Forming Apparatus (Liquid Developing Device)

Next, a sixth embodiment of the image forming apparatus (liquid developing device) according to the embodiment of the invention will be described below. In the following description, only the components of the image forming apparatus (liquid developing device) according to the sixth embodiment different from those in the third embodiment will be described, and a description of the same components as those in the third embodiment will be omitted.

The image forming apparatus (liquid developing device) according to the sixth embodiment uses the above-mentioned liquid developer to form a color image on a recording medium according to the image forming method according to the second embodiment.

As shown in FIG. 5, an image forming apparatus 1000" according to this embodiment includes a liquid developing device 10" and a fixing device F40, similar to the image forming apparatus according to the third embodiment.

The image forming apparatus 1000" (liquid developing device 10") according to the sixth embodiment is similar to the image forming apparatus (liquid developing device) according to the third embodiment except that a largest amount of oxidation polymerization accelerator is contained in a liquid developer contained in a developing section that transfers a single color image onto an intermediate transfer section 70 at the beginning, that is, a developing section 15K.

That is, a largest amount of oxidation polymerization accelerator is contained in a liquid developer (first liquid developer) forming a single color image that is positioned closest to a recording medium, among a plurality of single color images forming a non-fixed color image.

That is, this embodiment is characterized in that the oxidation polymerization accelerator content of the liquid developer contained in the developing section that transfers a single color image onto the intermediate transfer section 70 at the beginning is larger than the oxidation polymerization accelerator content of a liquid developer contained in each of the other developing sections.

This structure causes the single color image in the vicinity of the outer surface of the non-fixed toner image transferred onto the recording medium to have a lower oxidation polymerization accelerator content than a single color image formed of the first liquid developer, which makes it possible to reduce the influence of the color of the oxidation polymerization accelerator on the quality of an image and thus prevent a reduction in the quality of a formed image.

Since the non-fixed toner image is transferred such that a layer (single color image) including a largest amount of oxidation polymerization accelerator contacts the recording medium, it is possible to strongly fix toner particles.

The oxidation polymerization accelerator content is the same as that in the second embodiment of the image forming method.

Although exemplary embodiments of the invention have been described above, the invention is not limited thereto.

For example, the image forming method according to any one of the above-described embodiments of the invention may additionally include appropriate processes, if necessary.

Further, the components of the liquid developing device and the image forming device according to the above-described embodiment of the invention may be replaced with components having the same functions, or the liquid developing device and the image forming device may include additional components.

In the above-described embodiments, four color liquid developers, that is, magenta, yellow, cyan, and black liquid developers, are used to form an image, but the invention is not limited thereto. For example, liquid developers corresponding to 5 colors or six or more colors may be used. For example, liquid developers that have different colors but are in the same color systems as magenta, yellow, and cyan may be added.

Further, the liquid developing device and the image forming device according to the above-described embodiment are not limited to the structures shown in the drawings.

In the above-described embodiments, the developing section for forming a single image color positioned closest to the recording medium contains a liquid developer corresponding to black, but the invention is not limited thereto. For example, the developing section may contain a liquid developer corresponding to magenta, yellow, or cyan.

The fixing device applied to the image forming method according to the above-described embodiment is not limited to the above, and the components of the fixing device may be replaced with components having the same functions as describe above, or the fixing device may be provided with additional components.

In the above-described embodiments, heat is applied during fixation, but the invention is not limited thereto. For example, ultraviolet rays may be radiated during fixation.

Further, in the above-described embodiments, the fixing roller applies heat, but the invention is not limited thereto. For example, the pressure roller may apply heat.

EXAMPLES

1. Production of Liquid Developer

Black Liquid Developer A-1

First, 80 parts by weight of a polyester resin having plural —$SO_3$— groups (sulfonic acid Na group) on the branched chain (glass transition temperature: 55° C., softening point: 123° C.) as a self-dispersing resin, 20 parts by weight of carbon black as a coloring agent were prepared. These components were mixed using a 20 L type Henschel mixer to obtain a material for producing a toner.

Next, the material (mixture) was kneaded using a biaxial kneader-extruder shown. The kneaded material extruded from the extruding port of the biaxial kneader-extruder was cooled.

The kneaded material that had been cooled as described above was coarsely ground into powder having an average particle size of 1.0 mm or less. Coarsely grounding was carried using a hammer mill.

Next, 250 parts by weight of toluene was added to 100 parts by weight of the coarse ground product of the kneaded material, and then it was subjected to a treatment using an ultrasound homogenizer (output: 400 μA) for one hour to obtain a solution in which the self-dispersing resin of the kneaded material was dissolved. The pigment was finely dispersed homogeneously in the solution.

Further, a water-based liquid composed of 700 parts by weight of ion-exchanged water was prepared.

The water-based liquid was stirred with a homomixer (PRIMIX Corporation) with the number of stirring being adjusted.

The above-mentioned solution (that is, the toluene solution of the kneaded material) was dropped in the water-based liquid which is being stirred, to obtain a water-based emulsion in which a dispersoid composed of particles having an average particle size of 1.2 μm was homogeneously dispersed.

Thereafter, the toluene in the water-based emulsion was removed under the conditions in which a temperature was 100° C. and an ambience pressure was 80 kPa, and then it was cooled to a room temperature to thereby obtain a water-based suspension in which solid fine particles were dispersed. In the thus obtained water-based suspension, substantially no toluene remains. The concentration of the solid component (dispersoid) of the thus obtained water-based suspension was 30.5 wt. Further, the average particle size of the particles of the dispersoid (solid fine particles) dispersed in the suspension was 0.8 μm. The measurement of the average particle size of the dispersoid was carried out using a laser diffraction/scattering type particle size distribution measurement apparatus ('LA-920' a product name of HORIBA Ltd.).

Thus obtained suspension was spray-dried to remove the dispersant from the discharged liquid droplets of the water-based suspension, thereby obtaining dry toner particles.

100 parts by weight of the toner particles, 160 parts by weight of the high iodine value linseed oil (manufactured by Nisshin Oilio Group, Ltd.) as an insulating liquid, 4 parts by weight of a polyamine/aliphatic polycondensation product as a dispersant (manufactured by Lubrizol Japan, Ltd., trade name 'Solsperse 11200'), and 0.56 parts by weight of aluminum stearate as a charge control agent were prepared.

These components were dispersed using an emulsion dispersing machine (manufactured by M Technique Co., Ltd.) at a rotation speed of 10000 rpm, taking care not to raise the temperature of the liquid no higher than the glass transition temperature of the resin. Then, 1 part by weight of the encapsulated cobalt octylate as an oxidation polymerization accelerator was added thereto to obtain a liquid developer K.

In the obtained liquid developer K, the average particle size of the toner particles was 1.0 μm, and the standard deviation of each of the toner particles was 0.45 μm.

Furthermore, cobalt octylate was encapsulated by the following method.

First, 10 g of cobalt octylate was dissolved in 15 ml of acetone, and the thus obtained solution was adsorbed by a porous hydrophilic silica gel to thereby obtain core bodies. Then, 10 g of the thus obtained core bodies and 20 g of polyethylene glycol (PEG) were heated and mixed to thereby obtain a mixture.

Thereafter, the mixture was put into 400 ml of a solvent (AF6, manufactured by NIPPON MITSUBISHI OIL CORPORATION), and it was sufficiently dispersed in the solvent by a homomixer, then it was gradually cooled down so that PEG was settled down. Then, the solvent was removed by filtration to obtain an encapsulated cobalt octylate.

Black Liquid Developer A-1'

A liquid developer A-1' was prepared in the same manner as for the liquid developer A-1 except that the oxidation polymerization accelerator was not added.

Yellow Liquid Developer A-2

A liquid developer A-2 was prepared in the same manner as for the liquid developer A-1 except that a yellow pigment (Pigment Yellow 93 manufactured by Dainichiseika Color & Chemicals Mfg. Co., Ltd.) was used as a coloring agent, and the oxidation polymerization accelerator was not added.

Magenta Liquid Developer A-3

A liquid developer A-3 was prepared in the same manner as for the liquid developer A-1 except that a magenta pigment (Pigment Red 122 manufactured by Dainichiseika Color & Chemicals Mfg. Co., Ltd.) was used as a coloring agent, and the oxidation polymerization accelerator was not added.

Cyan Liquid Developer A-4

A liquid developer A-4 was prepared in the same manner as for the liquid developer A-1 except that a cyan pigment (Pigment Blue 15:3 manufactured by Dainichiseika Color & Chemicals Mfg. Co., Ltd.) was used as a coloring agent, and the oxidation polymerization accelerator was not added.

Cyan Liquid Developer A-4'

A liquid developer A-4' was prepared in the same manner as for the liquid developer A-1 except that a cyan pigment (Pigment Blue 15:3 manufactured by Dainichiseika Color & Chemicals Mfg. Co., Ltd.) was used as a coloring agent.

Black Liquid Developer B-1

First, 80 parts by weight of an epoxy resin (EPICOAT 1004, softening point $T_f$: 128° C.) as a resin material, and 20 parts by weight of carbon black as a coloring agent were prepared. These components were mixed using a 20 L type Henschel mixer to obtain a material for producing a toner.

Next, the material (mixture) was kneaded using a biaxial kneader-extruder shown. The kneaded material extruded from the extruding port of the biaxial kneader-extruder was cooled using a cooler. The kneaded material that had been cooled was coarsely ground into powder having an average particle size of 1.0 mm or less. Coarsely grounding was carried using a hammer mill.

Next, 100 parts by weight of the obtained coarse ground product, 100 parts by weight of methyl oleate as a first liquid, 10 parts by weight of a polyamine/aliphatic polycondensation product as a dispersant (manufactured by Lubrizol Japan, Ltd., trade name 'Solsperse 11200'), and 1.4 parts by weight of magnesium stearate as a charge control agent were prepared.

These components were put into a ball mill, and wet pulverized for 200 hours to obtain a dispersion of the pulverized product. Thereafter, 100 parts by weight of the obtained dispersion of the pulverized product and 400 parts by weight of high-oleic rape seed oil (manufactured by Nisshin Oilio Group, Ltd.) as a second liquid were mixed, and in the same manner as for the preparation of the liquid developer A-1, 1 part by weight of encapsulated cobalt octylate was added thereto, to obtain a liquid developer B-1.

In the obtained liquid developer B, the average particle size of the toner particles was 1.5 μm, and the standard deviation of each of the toner particles was 0.48 μm.

Yellow Liquid Developer B-2

A liquid developer B-2 was prepared in the same manner as for the liquid developer B-1 except that a yellow pigment (Pigment Yellow 93 manufactured by Dainichiseika Color & Chemicals Mfg. Co., Ltd.) was used as a coloring agent, and the oxidation polymerization accelerator was not added.

Magenta Liquid Developer B-3

A liquid developer B-3 was prepared in the same manner as for the liquid developer B-1 except that a magenta pigment (Pigment Red 122 manufactured by Dainichiseika Color & Chemicals Mfg. Co., Ltd.) was used as a coloring agent, and the oxidation polymerization accelerator was not added.

Cyan Liquid Developer B-4

A liquid developer B-4 was prepared in the same manner as for the liquid developer B-1 except that a cyan pigment (Pigment Blue 15:3 manufactured by Dainichiseika Color & Chemicals Mfg. Co., Ltd.) was used as a coloring agent, and the oxidation polymerization accelerator was not added.

Black Liquid Developer C-1

First, 80 parts by weight of an epoxy resin (EPICOAT 1004, softening point $T_f$: 128° C.) as a resin material, and 20 parts by weight of carbon black as a coloring agent were prepared. These components were mixed using a 20 L type Henschel mixer to obtain a material for producing a toner.

Next, the material (mixture) was kneaded using a biaxial kneader-extruder shown. The kneaded material extruded from the extruding port of the biaxial kneader-extruder was cooled using a cooler. The kneaded material that had been cooled was coarsely ground into powder having an average particle size of 1.0 mm or less. Coarsely grounding was carried using a hammer mill.

Next, 100 parts by weight of the obtained coarse ground product, 100 parts by weight of Isopar H (manufactured by Exxon Chemical, trade name), 10 parts by weight of a polyamine/aliphatic polycondensation product as a dispersant (manufactured by Lubrizol Japan, Ltd., trade name 'Solsperse 11200'), and 1.4 parts by weight of magnesium stearate as a charge control agent were prepared.

These components were put into a ball mill, and wet pulverized for 200 hours to obtain a dispersion of the pulverized product. Thereafter, 100 parts by weight of the obtained dispersion of the pulverized product and 400 parts by weight of Isopar H were mixed to obtain a liquid developer C.

In the obtained liquid developer C, the average particle size of the toner particles was 1.5 μm, and the standard deviation of each of the toner particles was 0.48 μm Yellow Liquid Developer C-2

A liquid developer C-2 was prepared in the same manner as for the liquid developer C-1 except that a yellow pigment (Pigment Yellow 93 manufactured by Dainichiseika Color & Chemicals Mfg. Co., Ltd.) was used as a coloring agent.

Magenta Liquid Developer C-3

A liquid developer C-3 was prepared in the same manner as for the liquid developer C-1 except that a magenta pigment (Pigment Red 122 manufactured by Dainichiseika Color & Chemicals Mfg. Co., Ltd.) was used as a coloring agent.

Cyan Liquid Developer C-4

A liquid developer C-4 was prepared in the same manner as for the liquid developer C-1 except that a cyan pigment (Pigment Blue 15:3 manufactured by Dainichiseika Color & Chemicals Mfg. Co., Ltd.) was used as a coloring agent.

2. Image Forming

Example 1

As shown in FIG. 1, to the developing sections 15Y, 15M, 15C, and 15K of the liquid developing device 10, the liquid developers A-2, A-3, A-4 and A-1 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 2

As shown in FIG. 1, to the developing sections 15Y, 15M, 15C, and 15K of the liquid developing device 10, the liquid developers A-2, A-3, A-4' and A-1 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 3

As shown in FIG. 1, to the developing sections 15Y, 15M, 15C, and 15K of the liquid developing device 10, the liquid developers B-2, B-3, B-4 and B-1 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 1

As shown in FIG. 1, to the developing sections 15Y, 15M, 15C, and 15K of the liquid developing device 10, the liquid developers A-1, A-2, A-3 and A-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 2

As shown in FIG. 1, to the developing sections 15Y, 15M, 15C, and 15K of the liquid developing device 10, the liquid developers A-2, A-3, A-4' and A-1' were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 3

As shown in FIG. 1, to the developing sections 15Y, 15M, 15C, and 15K of the liquid developing device 10, the liquid developers A-2, A-3, A-4 and A-1' were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 4

As shown in FIG. 1, to the developing sections 15Y, 15M, 15C, and 15K of the liquid developing device 10, the liquid developers C-2, C-3, C-4 and C-1 were put, and an unfixed, predetermined pattern of the toner image was formed on the recording medium (Fuji Xerox Office Supply, Inc.; high-quality paper for PPC, d-paper) under a condition of room temperature. Then, a fixing device as shown in FIG. 3 was used for fixing.

For Examples 1 to 3, and Comparative Examples 1 to 4, the colors of the liquid developer put into the developing sections and whether or not the oxidation polymerization accelerator was present are shown in Table 1.

TABLE 1

| | Developing section 15Y | | Developing section 15M | | Developing section 15C | | Developing section 15K (Developing section finally transferring monochrome image for the intermediate transferring sections) | |
|---|---|---|---|---|---|---|---|---|
| | Color | Whether or not the oxidation polymerization accelerator was present | Color | Whether or not the oxidation polymerization accelerator was present | Color | Whether or not the oxidation polymerization accelerator was present | Color | Whether or not the oxidation polymerization accelerator was present |
| Example 1 | Yellow | None | Magenta | None | Cyan | None | Black | Present |
| Example 2 | Yellow | None | Magenta | None | Black | None | Cyan | Present |
| Example 3 | Yellow | None | Magenta | None | Cyan | None | Black | Present |
| Comparative Example 1 | Black | Present | Yellow | None | Magenta | None | Cyan | None |
| Comparative Example 2 | Yellow | None | Magenta | None | Cyan | Present | Black | None |
| Comparative Example 3 | Yellow | None | Magenta | None | Cyan | None | Black | None |
| Comparative Example 4 | Yellow | None | Magenta | None | Cyan | None | Black | None |

3. Evaluation 3-1. Fixing Strength

The fixed toner image on the recording mediums obtained in Examples and Comparative Examples was rubbed out twice using a sand eraser (manufactured by LION OFFICE PRODUCTS CORP., trade name: 'LION 261-11') with a pressure loading of 1.0 kgf. The residual rate of the image density was measured by a colorimeter 'X-Rite model 404' manufactured by X-Rite Incorporated, and the measurement results were evaluated according to the following five criteria.

◎◎: Residual rate of the image density was 95% or higher.

◎: Residual rate of the image density was 90% or higher but lower than 95%.

○: Residual rate of the image density was 80% or higher but lower than 90%.

Δ: Residual rate of the image density was 70% or higher but lower than 80%.

x: Residual rate of the image density was lower than 70%.

3-2. Evaluation on Image Quality (Color)

The patch having a mixed color of magenta, yellow and cyan and the patch in black after fixation were measured on their colors using an X-Rite 968, and then the color reproducibility relative to the fixed patch in the case of not adding the oxidation polymerization accelerator was evaluated.

○: The color was not different from that of the original one ($\Delta E \leqq 3$).

Δ: The color was slightly different from that of the original one ($3 < \Delta E \leqq 5$).

x: The color was greatly different from that of the original one ($\Delta E \geqq 5$).

The results are shown in Table 2.

TABLE 2

| | Fixing strength | | Evaluation |
|---|---|---|---|
| | Residual rate of image density [%] | Evaluation | on image quality |
| Example 1 | 98 | ◎◎ | ○ |
| Example 2 | 94 | ◎ | ○ |
| Example 3 | 89 | ○ | ○ |
| Comparative Example 1 | 93 | ◎ | X |
| Comparative Example 2 | 92 | ◎ | X |
| Comparative Example 3 | 72 | Δ | ○ |
| Comparative Example 4 | 60 | X | ○ |

As clearly shown in Table 2, in Examples 1 to 3, both of the fixing strength and the image quality were excellent. To the contrary, in Comparative Examples 1 to 4, satisfactory results could not be obtained.

4. Preparation of Liquid Developer

Black Liquid Developer D-1

Preparation of Insulating Liquid

The liquid including the unsaturated fatty acid glyceride and the liquid including the fatty acid monoester, used as the insulating liquids, were prepared in the following manner.

Preparation of Liquid Including Unsaturated Fatty Acid Glyceride

First, crude soy oil was purified in the following manner to obtain a purified soy oil.

At first, low-temperature crystallization was carried out using methanol, diethyl ether, petroleum ether, acetone, or the like as a solvent to obtain a roughly refined soy oil.

Then, 300 parts by volume of the crude soy oil (first roughly refined oil) was put into a flask, and then 100 parts by volume of boiled water was poured into the flask, and the flask was then plugged.

Next, the flask was shaken so that the crude soy oil (first roughly refined oil) and the boiled water were mixed.

Then, the flask was left until a mixed solution therein was separated into three layers.

After it was confirmed that the mixed solution was completely separated into three layers, the flask was put in a freezer and left for 24 hours Subsequently, an unfrozen component in the mixed solution was taken out and put into a second flask, and the unfrozen component was again subjected to the same-operation as described above. Then, an unfrozen component was taken out from the second flask to obtain a crude fatty oil (second roughly refined oil).

Then, 100 parts by volume of the thus obtained roughly refined fatty oil (second roughly refined oil) and 35 parts by volume of an activated earth mainly composed of hydrous silicic aluminum were put in a flask and they were mixed and stirred.

Thereafter, the thus obtained mixture was left for 48 hours under a pressure (0.18 MPa) so that the activated earth was completely settled down.

Then, the precipitate was removed to obtain a refined soy oil (which may be simply referred to as soy oil, hereinafter). Further, the soy oil contained the unsaturated fatty acid glycerides of linoleic acid as a main component, and the amount of the unsaturated fatty acid glyceride contained in the soy oil was 98 wt %. Further, the amount of the linoleic acid component in the total fatty acid components was 53 mol %.

Preparation of Liquid of Fatty Acid Monoester

Thereafter, a portion of the soy oil and methanol were subject to esterification, and the glycerin produced therefrom was removed to obtain a liquid mainly including a fatty acid monoester. Moreover, this liquid was purified to obtain a soy oil fatty acid methyl ester having the content of the fatty acid monoester of 99.9 wt % or more. Thus, the obtained fatty acid monoester is mainly composed of an unsaturated fatty acid monoester such as methyl oleate, methyl linoleate and methyl α-linoleate, and a saturated fatty acid monoester such as methyl plamitate and methyl stearate.

Preparation of Toner Particles

Preparation of Coloring Agent Master Solution

First, a mixture (weight ratio 50:50) of a polyester resin (solution viscosity: 125° C., Tg: 60.5° C., Acid value: 7.7), and carbon black as a coloring agent was prepared. These components were mixed using a 20 L type Henschel mixer to obtain a material for producing a toner.

Next, the material (mixture) was kneaded using a biaxial kneader-extruder shown. The kneaded material extruded from the extruding port of the biaxial kneader-extruder was cooled.

The kneaded material that had been cooled as described above was coarsely ground into powder having an average particle size of 1.0 mm or less. Coarsely grounding was carried using a hammer mill.

To the powder of the obtained kneaded material, methyl ethyl ketone was added such that the solid content was 30 wt %, and the resultant was wet pulverized using an Eiger Motor Mill (a bead mill manufactured by Eiger Engineering Limited, USA, M-1000) to prepare a coloring agent master solution.

Preparation of Resin Solution

To 33 parts by weight of the coloring agent master solution, 200 parts by weight of methyl ethyl ketone and 73 parts by weight of the polyester resin were added, and mixed using an Eiger Motor Mill (a bead mill manufactured by Eiger Engineering Limited, USA, M-1000) to prepare a resin solution. Further, the pigment was finely dispersed homogeneously in the solution.

Preparation of Water-Based Emulsion

To a cylindrical 2 L-separable flask equipped with a Max Blend stirring blade, 500 parts by weight of the resin solution, 45.5 parts by weight of methyl ethyl ketone were put such that the solid content of the resin solution was 55%.

Then, to the resin solution in the flask, 41.7 parts by weight of 1 N aqueous ammonia (the molar equivalents relative to the total amount of the carboxylic groups contained in the polyester resin was 1.1) was added, and then the mixture was sufficiently stirred using a three one motor (manufactured by Shinto Scientific Co., Ltd.) at a rotation speed of the stirring blade of 210 rpm (peripheral speed of the stirring blade: 0.71 m/s). Then, while continuing the stirring, 133 parts by weight of deionized water was added thereto. The temperature of the solution in the flask was adjusted to 25° C., and while continuing the stirring, 133 parts by weight of deionized water was added dropwise to the resin solution to cause inversion emulsification, thereby obtaining a water-based emulsion having a dispersoid including the resin material.

Preparation of Aggregated Particles by Aggregation

While continuing the stirring in flask, 285 parts by weight of deionized water was added to the water-based emulsion such that the total amount of the 1 N aqueous ammonia and water was 593 parts by weight. Then, for the water-based emulsion, 2.6 parts by weight of an anion type emulsifier, Emarl 0 (manufactured by Kao company) was diluted with 30 parts by weight of deionized water, and then added.

Thereafter, while maintaining the temperature of the water-based emulsion at 25° C., stirring was carried out at a rotation speed of 150 rpm (peripheral speed of the stirring blade: 0.54 m/s). Then, 300 parts by weight of a 3.5% aqueous solution of ammonium sulfate was added dropwise thereto, such that the particle size of the aggregate of the dispersoid was 3.5 μm. After dropwise addition, stirring was continued until the particle size of the aggregate of the dispersoid was grown to 5.0 μm, and then the aggregation process was stopped.

For the obtained aggregate dispersion, the organic solvent was distilled off under reduced pressure for drying, to obtain aggregated particles.

Preparation of Liquid Developer 40 parts by weight of the obtained aggregated particles, 80 parts by weight of soy oil fatty acid methyl ester, and 1 part by weight of a polyamine/aliphatic polycondensation product (manufactured by Lubrizol Japan, Ltd., trade name 'Solsperse 13940') were put to a ceramic port (internal volume: 600 ml), and zirconium oxide balls (ball diameter: 1 mm) was further added to the ceramic port such that the volume charging rate became 25%. Pulverization was carried out using a desk port mill at a rotation speed of 210 rpm (l/min) for 120 hours, and the dispersion in the port was separated from the zirconium oxide ball to obtain a dispersion of the toner particles.

Thereafter, to the obtained dispersion of the toner particles, 120 parts by weight of refined soy oil, 0.5 part by weight of zinc stearate (manufactured by Nippon Oil & Fats) as a charge control agent, and 0.5 part by weight of encapsulated cobalt naphthenate (amount added as pure component of cobalt naphthenate) as an oxidation polymerization accelerator were added, and pulverization was further carried out for 24 hours to obtain a liquid developer D-1.

In the obtained liquid developer D-1, the average particle size (volume-based average particle size) of the toner particles was 1.9 μm, and the standard deviation of each of the toner particles was 0.54 μm.

The average particle size and the particle size distribution of the toner particles were measured using a Mastersizer 2000 Particle Size Analyzer (manufactured by Malvern Instruments Ltd.).

Furthermore, cobalt naphthenate was encapsulated by the following method.

First, 10 g of cobalt naphthenate was dissolved in 15 ml of acetone, and the thus obtained solution was adsorbed by a porous hydrophilic silica gel to thereby obtain core bodies. Then, 10 g of the thus obtained core bodies and 20 g of polyethylene glycol (PEG) were heated and mixed to thereby obtain a mixture.

Thereafter, the mixture was put into 400 ml of a solvent (AF6, manufactured by NIPPON MITSUBISHI OIL CORPORATION), and it was sufficiently dispersed in the solvent by a homomixer, then it was gradually cooled down so that PEG was settled down. Then, the solvent was removed by filtration to obtain an encapsulated cobalt naphthenate.

Magenta Liquid Developer D-2

A liquid developer D-2 was prepared in the same manner as for the liquid developer D-1 except that a magenta pigment (Pigment Red 122 manufactured by Dainichiseika Color & Chemicals Mfg. Co., Ltd.) was used as a coloring agent, and the content of the oxidation polymerization accelerator was 0.15 parts by weight based on 100 parts by weight of the insulating liquid.

Cyan Liquid Developer D-3

A liquid developer D-3 was prepared in the same manner as for the liquid developer D-1 except that a cyan pigment (Pigment Blue 15:3 manufactured by Dainichiseika Color & Chemicals Mfg. Co., Ltd.) was used as a coloring agent, and the content of the oxidation polymerization accelerator was 0.1 part by weight based on 100 parts by weight of the insulating liquid.

Yellow Liquid Developer D-4

A liquid developer D-4 was prepared in the same manner as for the liquid developer D-1 except that a yellow pigment (Pigment Yellow 93 manufactured by Dainichiseika Color & Chemicals Mfg. Co., Ltd.) was used as a coloring agent, and the content of the oxidation polymerization accelerator was 0.01 part by weight based on 100 parts by weight of the insulating liquid.

Black Liquid Developer E-1

A liquid developer E-1 was prepared in the same manner as for the liquid developer D-1 except that the oxidation polymerization accelerator was not added.

Magenta Liquid Developer E-2

A liquid developer E-2 was prepared in the same manner as for the liquid developer D-1 except that a magenta pigment (Pigment Red 122 manufactured by Dainichiseika Color & Chemicals Mfg. Co., Ltd.) was used as a coloring agent, and the oxidation polymerization accelerator was not added.

Cyan Liquid Developer E-3

A liquid developer E-3 was prepared in the same manner as for the liquid developer D-1 except that a cyan pigment (Pigment Blue 15:3 manufactured by Dainichiseika Color & Chemicals Mfg. Co., Ltd.) was used as a coloring agent, and the oxidation polymerization accelerator was not added.

Yellow Liquid Developer E-4

A liquid developer E-4 was prepared in the same manner as for the liquid developer D-1 except that a yellow pigment (Pigment Yellow 93 manufactured by Dainichiseika Color & Chemicals Mfg. Co., Ltd.) was used as a coloring agent, and the oxidation polymerization accelerator was not added.

Black Liquid Developer F-1

A liquid developer F-1 was prepared in the same manner as for the liquid developer D-1 except that the content of the oxidation polymerization accelerator was 2 parts by weight based on 100 parts by weight of the insulating liquid.

Magenta Liquid Developer F-2

A liquid developer F-2 was prepared in the same manner as for the liquid developer D-1 except that a magenta pigment (Pigment Red 122 manufactured by Dainichiseika Color & Chemicals Mfg. Co., Ltd.) was used as a coloring agent, and the content of the oxidation polymerization accelerator was 1 part by weight based on 100 parts by weight of the insulating liquid.

Cyan Liquid Developer F-3

A liquid developer F-3 was prepared in the same manner as for the liquid developer D-1 except that a cyan pigment (Pigment Blue 15:3 manufactured by Dainichiseika Color & Chemicals Mfg. Co., Ltd.) was used as a coloring agent, and the content of the oxidation polymerization accelerator was 0.6 part by weight based on 100 parts by weight of the insulating liquid.

Yellow Liquid Developer F-4

A liquid developer F-4 was prepared in the same manner as for the liquid developer D-1 except that a yellow pigment (Pigment Yellow 93 manufactured by Dainichiseika Color & Chemicals Mfg. Co., Ltd.) was used as a coloring agent, and the content of the oxidation polymerization accelerator was 0.2 part by weight based on 100 parts by weight of the insulating liquid.

Black Liquid Developer G-1

A liquid developer G-1 was prepared in the same manner as for the liquid developer D-1 except that the content of the oxidation polymerization accelerator was 0.5 part by weight based on 100 parts by weight of the insulating liquid.

Magenta Liquid Developer G-2

A liquid developer G-2 was prepared in the same manner as for the liquid developer D-1 except that a magenta pigment (Pigment Red 122 manufactured by Dainichiseika Color & Chemicals Mfg. Co., Ltd.) was used as a coloring agent, and the content of the oxidation polymerization accelerator was 0.2 part by weight based on 100 parts by weight of the insulating liquid.

Cyan Liquid Developer G-3

A liquid developer G-3 was prepared in the same manner as for the liquid developer D-1 except that a cyan pigment (Pigment Blue 15:3 manufactured by Dainichiseika Color & Chemicals Mfg. Co., Ltd.) was used as a coloring agent, and the content of the oxidation polymerization accelerator was 0.1 part by weight based on 100 parts by weight of the insulating liquid.

Yellow Liquid Developer G-4

A liquid developer G-4 was prepared in the same manner as for the liquid developer D-1 except that a yellow pigment (Pigment Yellow 93 manufactured by Dainichiseika Color & Chemicals Mfg. Co., Ltd.) was used as a coloring agent, and the content of the oxidation polymerization accelerator was 0.04 part by weight based on 100 parts by weight of the insulating liquid.

Black Liquid Developer H-1

A liquid developer H-1 was prepared in the same manner as for the liquid developer D-1 except that the content of the oxidation polymerization accelerator was 0.1 part by weight based on 100 parts by weight of the insulating liquid.

Magenta Liquid Developer H-2

A liquid developer H-2 was prepared in the same manner as for the liquid developer D-1 except that a magenta pigment (Pigment Red 122 manufactured by Dainichiseika Color & Chemicals Mfg. Co., Ltd.) was used as a coloring agent, and the content of the oxidation polymerization accelerator was 0.01 part by weight based on 100 parts by weight of the insulating liquid.

Cyan Liquid Developer H-3

A liquid developer H-3 was prepared in the same manner as for the liquid developer D-1 except that a cyan pigment (Pigment Blue 15:3 manufactured by Dainichiseika Color &Chemicals Mfg. Co., Ltd.) was used as a coloring agent, and the content of the oxidation polymerization accelerator was 0.005 part by weight based on 100 parts by weight of the insulating liquid.

Yellow Liquid Developer H-4

A liquid developer H-4 was prepared in the same manner as for the liquid developer D-1 except that a yellow pigment (Pigment Yellow 93 manufactured by Dainichiseika Color & Chemicals Mfg. Co., Ltd.) was used as a coloring agent, and the content of the oxidation polymerization accelerator was 0.005 part by weight based on 100 parts by weight of the insulating liquid.

Black Liquid Developer I-1

A liquid developer I-1 was prepared in the same manner as for the liquid developer D-1 except that encapsulated manganese naphthenate was used as an oxidation polymerization accelerator.

Magenta Liquid Developer I-2

A liquid developer I-2 was prepared in the same manner as for the liquid developer D-1 except that encapsulated manganese naphthenate was used as an oxidation polymerization accelerator.

Cyan Liquid Developer I-3

A liquid developer I-3 was prepared in the same manner as for the liquid developer D-1 except that encapsulated manganese naphthenate was used as an oxidation polymerization accelerator.

Yellow Liquid Developer I-4

A liquid developer I-4 was prepared in the same manner as for the liquid developer D-1 except that encapsulated manganese naphthenate was used as an oxidation polymerization accelerator.

Black Liquid Developer J-1

A liquid developer J-1 was prepared in the same manner as for the liquid developer D-1 except that encapsulated manganese octylate was used as an oxidation polymerization accelerator.

Magenta Liquid Developer J-2

A liquid developer J-2 was prepared in the same manner as for the liquid developer D-1 except that encapsulated manganese octylate was used as an oxidation polymerization accelerator.

Cyan Liquid Developer J-3

A liquid developer J-3 was prepared in the same manner as for the liquid developer D-1 except that encapsulated manganese octylate was used as an oxidation polymerization accelerator.

Yellow Liquid Developer J-4

A liquid developer J-4 was prepared in the same manner as for the liquid developer D-1 except that encapsulated manganese octylate was used as an oxidation polymerization accelerator.

Black Liquid Developer K-1

A liquid developer K-1 was prepared in the same manner as for the liquid developer D-1 except that the content of the oxidation polymerization accelerator was 1 part by weight based on 100 parts by weight of the insulating liquid.

Magenta Liquid Developer K-2

A liquid developer K-2 was prepared in the same manner as for the liquid developer D-1 except that a magenta pigment (Pigment Red 122 manufactured by Dainichiseika Color & Chemicals Mfg. Co., Ltd.) was used as a coloring agent, and the content of the oxidation polymerization accelerator was 2 parts by weight based on 100 parts by weight of the insulating liquid.

Cyan Liquid Developer K-3

A liquid developer K-3 was prepared in the same manner as for the liquid developer D-1 except that a cyan pigment (Pigment Blue 15:3 manufactured by Dainichiseika Color & Chemicals Mfg. Co., Ltd.) was used as a coloring agent, and the content of the oxidation polymerization accelerator was 2 parts by weight based on 100 parts by weight of the insulating liquid.

Yellow Liquid Developer K-4

A liquid developer K-4 was prepared in the same manner as for the liquid developer D-1 except that a yellow pigment (Pigment Yellow 93 manufactured by Dainichiseika Color & Chemicals Mfg. Co., Ltd.) was used as a coloring agent, and the content of the oxidation polymerization accelerator was 2 parts by weight based on 100 parts by weight of the insulating liquid.

5. Image Forming

Example 4

As shown in FIG. 4, to the developing sections 15K, 15M, 15C and 15Y of the liquid developing device 10', the liquid developers D-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 5

As shown in FIG. 4, to the developing sections 15K, 15M, 15C and 15Y of the liquid developing device 10', the liquid developers F-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 6

As shown in FIG. 4, to the developing sections 15K, 15M, 15C and 15Y of the liquid developing device 10', the liquid developers G-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 7

As shown in FIG. 4, to the developing sections 15K, 15M, 15C and 15Y of the liquid developing device 10', the liquid developers H-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 8

As shown in FIG. 4, to the developing sections 15K, 15M, 15C and 15Y of the liquid developing device 10', the liquid developers I-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 9

As shown in FIG. 4, to the developing sections 15K, 15M, 15C and 15Y of the liquid developing device 10', the liquid developers J-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 10

As shown in FIG. 4, to the developing sections 15K, 15M, 15C and 15Y of the liquid developing device 10', the liquid developers K-3, E-2, E-1 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 11

As shown in FIG. 5, to the developing sections 15K, 15M, 15C and 15Y of the liquid developing device 10", the liquid developers D-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 12

As shown in FIG. 5, to the developing sections 15K, 15M, 15C and 15Y of the liquid developing device 10", the liquid developers F-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 13

As shown in FIG. 5, to the developing sections 15K, 15M, 15C and 15Y of the liquid developing device 10", the liquid developers G-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 14

As shown in FIG. 5, to the developing sections 15K, 15M, 15C and 15Y of the liquid developing device 10", the liquid developers H-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 15

As shown in FIG. 5, to the developing sections 15K, 15M, 15C and 15Y of the liquid developing device 10", the liquid developers I-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 16

As shown in FIG. 5, to the developing sections 15K, 15M, 15C and 15Y of the liquid developing device 10", the liquid developers J-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 17

As shown in FIG. 5, to the developing sections 15K, 15M, 15C and 15Y of the liquid developing device 10", the liquid developers K-3, E-2, E-1 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 18

As shown in FIG. 4, to the developing sections 15K, 15M, 15C and 15Y of the liquid developing device 10', the liquid developers D-1, D-2, D-3 and D-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 19

As shown in FIG. 4, to the developing sections 15K, 15M, 15C and 15Y of the liquid developing device 10', the liquid developers F-1, F-2, F-3 and F-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 20

As shown in FIG. 4, to the developing sections 15K, 15M, 15C and 15Y of the liquid developing device 10', the liquid developers G-1, G-2, G-3 and G-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 21

As shown in FIG. 4, to the developing sections 15K, 15M, 15C and 15Y of the liquid developing device 10', the liquid developers H-1, H-2, H-3 and H-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 22

As shown in FIG. 4, to the developing sections 15K, 15M, 15C and 15Y of the liquid developing device 10', the liquid developers I-1, I-2, I-3 and I-4 were put, and an unfixed, predetermined pattern of the toner image was formed on the recording medium (Fuji Xerox office Supply, Inc.; high-quality paper for PPC, J-paper) under a condition of room temperature. Then, a fixing device as shown in FIG. 3 was used for fixing.

Example 23

As shown in FIG. 4, to the developing sections 15K, 15M, 15C and 15Y of the liquid developing device 10', the liquid developers J-1, J-2, J-3 and J-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 24

As shown in FIG. 4, to the developing sections 15K, 15M, 15C and 15Y of the liquid developing device 10', the liquid developers D-3, D-2, H-1 and D-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 25

As shown in FIG. 5, to the developing sections 15K, 15M, 15C and 15Y of the liquid developing device 10", the liquid developers D-1, D-2, D-3 and D-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 26

As shown in FIG. 5, to the developing sections 15K, 15M, 15C and 15Y of the liquid developing device 10", the liquid developers F-1, F-2, F-3 and F-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 27

As shown in FIG. 5, to the developing sections 15K, 15M, 15C and 15Y of the liquid developing device 10", the liquid developers G-1, G-2, G-3 and G-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 28

As shown in FIG. 5, to the developing sections 15K, 15M, 15C and 15Y of the liquid developing device 10", the liquid developers H-1, H-2, H-3 and H-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 29

As shown in FIG. 5, to the developing sections 15K, 15M, 15C and 15Y of the liquid developing device 10", the liquid developers I-1, I-2, I-3 and I-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 30

As shown in FIG. 5, to the developing sections 15K, 15M, 15C and 15Y of the liquid developing device 10", the liquid developers J-1, J-2, J-3 and J-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Example 31

As shown in FIG. 5, to the developing sections 15K, 15M, 15C and 15Y of the liquid developing device 10", the liquid developers D-3, D-2, H-1 and D-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 5

As shown in FIG. 4, to the developing sections 15K, 15M, 15C and 15Y of the liquid developing device 10', the liquid developers E-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 6

As shown in FIG. 5, to the developing sections 15K, 15M, 15C and 15Y of the liquid developing device 10", the liquid developers E-1, E-2, E-3 and E-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 7

As shown in FIG. 4, to the developing sections 15K, 15M, 15C and 15Y of the liquid developing device 10', the liquid developers K-1, K-2, K-3 and K-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

Comparative Example 8

As shown in FIG. 5, to the developing sections 15K, 15M, 15C and 15Y of the liquid developing device 10", the liquid developers K-1, K-2, K-3 and K-4 were put, and an unfixed, predetermined pattern of the toner image was formed on the recording medium (Fuji Xerox Office Supply, Inc.; high-quality paper for PPC, J-paper) under a condition of room temperature. Then, a fixing device as shown in FIG. 3 was used for fixing.

For Examples 4 to 31, and Comparatives Example 5 to 8, figure numbers of the employed liquid developing device, the colors of the liquid developers put into each of the developing sections, and the contents of the oxidation polymerization accelerators based on 100 parts by weight of the insulating liquid are shown in Table 3.

◎◎: Residual rate of the image density was 95% or higher.

◎: Residual rate of the image density was 90% or higher but lower than 95%.

○: Residual rate of the image density was 80% or higher but lower than 90%.

Δ: Residual rate of the image density was 70% or higher but lower than 80%.

x: Residual rate of the image density was lower than 70%.

TABLE 3

| | | Developing section 15K | | Developing section 15M | | Developing section 15C | | Developing section 15Y | |
|---|---|---|---|---|---|---|---|---|---|
| | Liquid developing device | Color | Contents of oxidation polymerization accelerators based on 100 parts by weight of insulating liquid [Parts by weight] | Color | Contents of oxidation polymerization accelerators based on 100 parts by weight of insulating liquid [Parts by weight] | Color | Contents of oxidation polymerization accelerators based on 100 parts by weight of insulating liquid [Parts by weight] | Color | Contents of oxidation polymerization accelerators based on 100 parts by weight of insulating liquid [Parts by weight] |
| Ex. 4 | FIG. 4 | Black | 0.25 | Magenta | 0 | Cyan | 0 | Yellow | 0 |
| Ex. 5 | FIG. 4 | Black | 2 | Magenta | 0 | Cyan | 0 | Yellow | 0 |
| Ex. 6 | FIG. 4 | Black | 0.5 | Magenta | 0 | Cyan | 0 | Yellow | 0 |
| Ex. 7 | FIG. 4 | Black | 0.1 | Magenta | 0 | Cyan | 0 | Yellow | 0 |
| Ex. 8 | FIG. 4 | Black | 0.25 | Magenta | 0 | Cyan | 0 | Yellow | 0 |
| Ex. 9 | FIG. 4 | Black | 0.25 | Magenta | 0 | Cyan | 0 | Yellow | 0 |
| Ex. 10 | FIG. 4 | Cyan | 0.25 | Magenta | 0 | Black | 0 | Yellow | 0 |
| Ex. 11 | FIG. 5 | Black | 0.25 | Magenta | 0 | Cyan | 0 | Yellow | 0 |
| Ex. 12 | FIG. 5 | Black | 2 | Magenta | 0 | Cyan | 0 | Yellow | 0 |
| Ex. 13 | FIG. 5 | Black | 0.5 | Magenta | 0 | Cyan | 0 | Yellow | 0 |
| Ex. 14 | FIG. 5 | Black | 0.1 | Magenta | 0 | Cyan | 0 | Yellow | 0 |
| Ex. 15 | FIG. 5 | Black | 0.25 | Magenta | 0 | Cyan | 0 | Yellow | 0 |
| Ex. 16 | FIG. 5 | Black | 0.25 | Magenta | 0 | Cyan | 0 | Yellow | 0 |
| Ex. 17 | FIG. 5 | Cyan | 0.25 | Magenta | 0 | Black | 0 | Yellow | 0 |
| Ex. 18 | FIG. 4 | Black | 0.25 | Magenta | 0.15 | Cyan | 0.03 | Yellow | 0.01 |
| Ex. 19 | FIG. 4 | Black | 2 | Magenta | 1 | Cyan | 0.6 | Yellow | 0.2 |
| Ex. 20 | FIG. 4 | Black | 0.5 | Magenta | 0.2 | Cyan | 0.1 | Yellow | 0.04 |
| Ex. 21 | FIG. 4 | Black | 0.1 | Magenta | 0.01 | Cyan | 0.005 | Yellow | 0.005 |
| Ex. 22 | FIG. 4 | Black | 0.25 | Magenta | 0.15 | Cyan | 0.03 | Yellow | 0.01 |
| Ex. 23 | FIG. 4 | Black | 0.25 | Magenta | 0.15 | Cyan | 0.03 | Yellow | 0.01 |
| Ex. 24 | FIG. 4 | Cyan | 0.25 | Magenta | 0.15 | Black | 0.1 | Yellow | 0.01 |
| Ex. 25 | FIG. 5 | Black | 0.25 | Magenta | 0.15 | Cyan | 0.03 | Yellow | 0.01 |
| Ex. 26 | FIG. 5 | Black | 2 | Magenta | 1 | Cyan | 0.6 | Yellow | 0.2 |
| Ex. 27 | FIG. 5 | Black | 0.5 | Magenta | 0.2 | Cyan | 0.1 | Yellow | 0.04 |
| Ex. 28 | FIG. 5 | Black | 0.1 | Magenta | 0.01 | Cyan | 0.005 | Yellow | 0.005 |
| Ex. 29 | FIG. 5 | Black | 0.25 | Magenta | 0.15 | Cyan | 0.03 | Yellow | 0.01 |
| Ex. 30 | FIG. 5 | Black | 0.25 | Magenta | 0.15 | Cyan | 0.03 | Yellow | 0.01 |
| Ex. 31 | FIG. 5 | Cyan | 0.25 | Magenta | 0.15 | Black | 0.1 | Yellow | 0.01 |
| Comp. Ex. 5 | FIG. 4 | Black | 0 | Magenta | 0 | Cyan | 0 | Yellow | 0 |
| Comp. Ex. 6 | FIG. 5 | Black | 0 | Magenta | 0 | Cyan | 0 | Yellow | 0 |
| Comp. Ex. 7 | FIG. 4 | Black | 1 | Magenta | 2 | Cyan | 2 | Yellow | 2 |
| Comp. Ex. 8 | FIG. 5 | Black | 1 | Magenta | 2 | Cyan | 2 | Yellow | 2 |

6. Evaluation

6-1. Fixing Strength

The fixed toner image on the recording mediums obtained in Examples and Comparative Examples was rubbed out three times using a sand eraser (manufactured by LION OFFICE PRODUCTS CORP., trade name: 'LION 261-11') with a pressure loading of 1.5 kgf. The residual rate of the image density was measured by a colorimeter 'X-Rite model 404' manufactured by X-Rite Incorporated, and the measurement results were evaluated according to the following five criteria.

6-2. Evaluation on Image Quality (Color)

The patch having a mixed color of magenta, yellow and cyan and the patch in black after fixing were measured on their colors using an X-Rite 968, and then the color reproducibility relative to the fixed patch in the case of not adding the oxidation polymerization accelerator (Comparative Example 5) was evaluated according to the following criteria.

◎: The color was not different from that of the original one ($\Delta E \leqq 2$).

○: The color was substantially not different from that of the original one ($2 < \Delta E \leqq 3$).

Δ: The color was slightly different from that of the original one ($3 < \Delta E \leqq 5$).

x: The color was greatly different from that of the original one (ΔE≧5).

The results are shown in Table 4.

TABLE 4

| | Fixing strength | | Evaluation |
|---|---|---|---|
| | Residual rate of image density [%] | Evaluation | on image quality |
| Example 4 | 84 | ○ | ◎ |
| Example 5 | 91 | ◎ | ◎ |
| Example 6 | 87 | ○ | ◎ |
| Example 7 | 86 | ○ | ◎ |
| Example 8 | 87 | ○ | ◎ |
| Example 9 | 88 | ○ | ◎ |
| Example 10 | 82 | ○ | ○ |
| Example 11 | 86 | ○ | ◎ |
| Example 12 | 90 | ◎ | ◎ |
| Example 13 | 85 | ○ | ◎ |
| Example 14 | 83 | ○ | ◎ |
| Example 15 | 84 | ○ | ◎ |
| Example 16 | 87 | ○ | ◎ |
| Example 17 | 82 | ○ | ○ |
| Example 18 | 95 | ◎◎ | ◎ |
| Example 19 | 97 | ◎◎ | ○ |
| Example 20 | 92 | ◎ | ◎ |
| Example 21 | 91 | ◎ | ◎ |
| Example 22 | 98 | ◎◎ | ◎ |
| Example 23 | 97 | ◎◎ | ◎ |
| Example 24 | 96 | ◎◎ | ○ |
| Example 25 | 95 | ◎◎ | ◎ |
| Example 26 | 97 | ◎◎ | ○ |
| Example 27 | 94 | ◎ | ◎ |
| Example 28 | 93 | ◎ | ◎ |
| Example 29 | 97 | ◎◎ | ◎ |
| Example 30 | 96 | ◎◎ | ◎ |
| Example 31 | 95 | ◎◎ | ○ |
| Comparative Example 5 | 61 | X | ◎ |
| Comparative Example 6 | 65 | X | ◎ |
| Comparative Example 7 | 93 | ◎ | X |
| Comparative Example 8 | 94 | ◎ | X |

As clearly shown in Table 4, in each of Examples, both of the fixing strength and the image quality were excellent. To the contrary, in each of Comparative Examples, satisfactory results could not be obtained.

The entire disclosure of Japanese Patent Application Nos. 2006-030099, filed Feb. 7, 2006 and 2006-304512, filed Nov. 9, 2006 are expressly incorporated by reference herein.

What is claimed is:

1. An image forming method comprising:

by using a plurality of liquid developers having different colors, forming a plurality of single color images corresponding to the colors;

transferring a non-fixed color image onto a recording medium; and fixing the non-fixed color image onto the recording medium, wherein said fixing uses a fixing device that comprises a thermal fixing roller and a presser roller, wherein each of the liquid developers includes an insulating liquid containing unsaturated fatty acid components, a saturated fatty acid component, and a fatty acid monoester and toner particles dispersed in the insulating liquid, and an oxidation polymerization accelerator that accelerates an oxidation polymerization reaction of the unsaturated fatty acid components during fixation is contained in the liquid developer forming the single color image that is positioned closest to the recording medium among the plurality of single color images forming the non-fixed color image, wherein the oxidation polymerization accelerator is contained in only the liquid developer forming the single color image that is positioned closest to the recording medium among the plurality of single color images forming the non-fixed color image.

2. The image forming method according to claim 1, wherein the liquid developer forming the single color image that is positioned closest to the recording medium among the plurality of single color images forming the non-fixed color image forms a single color image corresponding to black.

3. The image forming method according to claim 1, wherein the insulating liquid includes a glyceride of unsaturated fatty acid and fatty acid monoester.

4. An image forming method comprising:

by using a plurality of liquid developers having different colors, forming a plurality of single color images corresponding to the colors;

transferring a non-fixed color image onto a recording medium; and fixing the non-fixed color image onto the recording medium, wherein said fixing uses a fixing device that comprises a thermal fixing roller and a presser roller, wherein each of the liquid developers includes an insulating liquid containing unsaturated fatty acid components, a saturated fatty acid component, and a fatty acid monoester and toner particles dispersed in the insulating liquid, and an oxidation polymerization accelerator that accelerates an oxidation polymerization reaction of the unsaturated fatty acid components during fixation is contained in the liquid developer forming the single color image that is positioned closest to the recording medium among the plurality of single color images forming the non-fixed color image, wherein a largest amount of oxidation polymerization accelerator is contained in the liquid developer forming the single color image that is positioned closest to the recording medium among the plurality of single color images forming the non-fixed color image.

5. The image forming method according to claim 4, wherein the oxidation polymerization accelerator content of the liquid developer forming the single color image that is positioned closest to the recording medium among the plurality of single color images forming the non-fixed color image is in a range of 0.01 to 2 parts by weight with respect to 100 parts by weight of insulating liquid.

6. An image forming method comprising:

by using a plurality of liquid developers having different colors, forming a plurality of single color images corresponding to the colors;

transferring a non-fixed color image onto a recording medium; and fixing the non-fixed color image onto the recording medium, wherein each of the liquid developers includes an insulating liquid containing unsaturated fatty acid components and toner particles dispersed in the insulating liquid, and an oxidation polymerization accelerator that accelerates an oxidation polymerization reaction of the unsaturated fatty acid components during fixation is contained in the liquid developer forming the single color image that is positioned closest to the recording medium among the plurality of single color images forming the non-fixed color image, wherein the oxidation polymerization accelerator is contained in the liquid developer in a capsulated state, and the oxidation polymerization accelerator is absorbed by a porous body.

7. A liquid developing device comprising:

a plurality of developing units that use a plurality of liquid developers having different colors to form a plurality of single color images corresponding to the colors;

a fixing device comprising a thermal fixer and a presser roller; and a transfer unit that transfers the plurality of single color images corresponding to the colors onto a recording medium so as to be superimposed with each other, thereby forming a non-fixed color image on the recording medium, wherein each of the liquid developers includes an insulating liquid containing unsaturated fatty acid components, a saturated fatty acid component, and a fatty acid monoester, and toner particles dispersed in the insulating liquid, and an oxidation polymerization accelerator that accelerates an oxidation polymerization reaction of the unsaturated fatty acid components during fixation is contained in only the liquid developer forming the single color image that is positioned closest to the recording medium among the plurality of single color images forming the non-fixed color image.

8. The liquid developing device according to claim 7, wherein the transfer unit includes:

an intermediate transfer unit onto which the plurality of single color images formed by the plurality of developing units are sequentially transferred and which forms an intermediate transfer image by superimposing the plurality of single color images transferred; and a secondary transfer unit that transfers the intermediate transfer image onto the recording medium, and one of the plurality of developing units that finally transfers the single color image onto the intermediate transfer unit contains the liquid developer including the oxidation polymerization accelerator.

9. The liquid developing device according to claim 7, wherein the transfer unit sequentially transfers the plurality of single color images formed by the plurality of developing units onto the recording medium when the recording medium is transported and forms the non-fixed color image obtained by superimposing the plurality of transferred single color images on the recording medium.

10. The liquid developing device according to claim 7, wherein the transfer unit includes:

an intermediate transfer unit onto which the plurality of single color images formed by the plurality of developing units are sequentially transferred so as to be superimposed with each other and which forms an intermediate transfer image by the superimposing the plurality of single color images transferred;

a secondary transfer unit onto which the intermediate transfer image is transferred and which transports the intermediate transfer image transferred; and a tertiary transfer unit which transfers the intermediate transfer image transferred onto the recording medium to form the non-fixed color image onto the recording medium.

11. The liquid developing device according to claim 7, wherein the developing unit includes a liquid developer reservoir that contains the liquid developer, and a reducing member that is formed of zeorite, which is a main component, and reduces the oxidized unsaturated fatty acid components is provided in the liquid developer reservoir that contains the liquid developer forming the single color image that is positioned closest to the recording medium among the plurality of single color images forming the non-fixed color image.

* * * * *